US009734793B2

(12) United States Patent
Hamagishi et al.

(10) Patent No.: US 9,734,793 B2
(45) Date of Patent: Aug. 15, 2017

(54) DISPLAY APPARATUS AND METHOD FOR ENABLING PERCEPTION OF THREE-DIMENSIONAL IMAGES

(71) Applicant: Samsung Display Co., Ltd., Yongin, Gyeonggi-Do (KR)

(72) Inventors: Goro Hamagishi, Hwaseongi-si (KR); Seung-Jun Yu, Suwon-si (KR); Sang-Min Jeon, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 1022 days.

(21) Appl. No.: 13/740,700

(22) Filed: Jan. 14, 2013

(65) Prior Publication Data

US 2014/0063083 A1 Mar. 6, 2014

(30) Foreign Application Priority Data

Sep. 3, 2012 (KR) ..... 10-2012-0096984

(51) Int. Cl.
*G09G 5/10* (2006.01)
*G09G 3/00* (2006.01)

(52) U.S. Cl.
CPC ..... *G09G 5/10* (2013.01); *G09G 3/003* (2013.01); *G09G 2300/0439* (2013.01); *G09G 2320/0209* (2013.01); *G09G 2320/0276* (2013.01); *G09G 2354/00* (2013.01)

(58) Field of Classification Search
CPC ..... G09G 5/10; H04N 13/0486
See application file for complete search history.

(56) References Cited

U.S. PATENT DOCUMENTS

| | | | | |
|---|---|---|---|---|
| 4,987,487 | A * | 1/1991 | Ichinose | G02B 27/0093 348/42 |
| 5,855,425 | A * | 1/1999 | Hamagishi | G02B 27/2214 348/E13.029 |
| 6,040,807 | A * | 3/2000 | Hamagishi | G02B 27/2214 345/6 |
| 6,710,920 | B1 * | 3/2004 | Mashitani | G02B 27/2214 353/7 |
| 2005/0190443 | A1 * | 9/2005 | Nam | G02B 27/2214 359/464 |

(Continued)

FOREIGN PATENT DOCUMENTS

| | | |
|---|---|---|
| KR | 1020110045654 | 5/2011 |
| KR | 1073567 | 10/2011 |

*Primary Examiner* — William Boddie
*Assistant Examiner* — Andrew Schnirel
(74) *Attorney, Agent, or Firm* — Innovation Counsel LLP

(57) ABSTRACT

A display apparatus may enable a viewer to perceive an image. The viewer has a right eye and a left eye, the right eye having a right pupil, the left eye having a left pupil. The display apparatus includes a display panel including a plurality of subpixels. The display apparatus further includes a position detecting part configured to detect a user location related to the viewer. The display apparatus further includes a light controlling element configured for transmitting light provided from one or more of the subpixels toward one or more of the right eye and the left eye. The display apparatus further includes a display panel driver configured to change subpixel-eye association for at least one of the subpixels in response to a change of the user location detected by the position detecting part.

9 Claims, 20 Drawing Sheets

(56) References Cited

U.S. PATENT DOCUMENTS

| | | | | |
|---|---|---|---|---|
| 2006/0126177 | A1 | 6/2006 | Kim et al. | |
| 2008/0259233 | A1* | 10/2008 | Krijn | H04N 13/0029 349/15 |
| 2009/0278936 | A1 | 11/2009 | Pastoor et al. | |
| 2009/0282429 | A1 | 11/2009 | Olsson et al. | |
| 2010/0182688 | A1 | 7/2010 | Kim et al. | |
| 2010/0271346 | A1 | 10/2010 | Ku et al. | |
| 2011/0228183 | A1* | 9/2011 | Hamagishi | G02B 27/2214 349/15 |
| 2013/0076735 | A1* | 3/2013 | Lee | H04N 13/0022 345/419 |

* cited by examiner

DISPLAY APPARATUS AND METHOD FOR ENABLING PERCEPTION OF THREE-DIMENSIONAL IMAGES

CROSS-REFERENCE TO RELATED APPLICATION

This application claims priority to and benefit of Korean Patent Application No. 10-2012-0096984, filed on Sep. 3, 2012, the contents of which are herein incorporated by reference.

BACKGROUND OF THE INVENTION

1. Field of the Invention

The present invention is related to a display apparatus for enabling perception of three-dimensional ("3D") images. The present invention is also related a method for enabling perception of 3D images.

2. Description of the Related Art

Display apparatuses for displaying three-dimensional ("3D") images have been implemented. The 3D-image display apparatuses may include stereoscopic image display apparatuses.

Generally, a stereoscopic image display apparatus displays a 3D image using binocular parallax between two eyes of a human. Since the two eyes of a human viewer are spaced apart from each other, images viewed at different angles are inputted to the viewer's brain. The viewer's brain mixes the images so that the viewer may recognize the 3D image.

Stereoscopic image display apparatuses may be categorized into stereoscopic type display apparatuses and auto-stereoscopic type display apparatuses, depending on whether a viewer wears an extra spectacle or not. Stereoscopic type display apparatuses may include anaglyph type display apparatuses, a shutter glass type display apparatuses, and so on. Auto-stereoscopic type display apparatuses may include lenticular type display apparatuses, barrier type display apparatuses, liquid crystal lens type display apparatuses, and liquid crystal barrier type display apparatuses.

In an auto-stereoscopic type display apparatus, a light controlling element may move or an image displayed on the display panel may be changed according to position changes of the viewer.

For moving the light controlling element, an additional driver may be required. As a result, the structure of the display apparatus may be complicated, associated operation may be complicated, and associated manufacturing cost and operation cost may undesirably high.

In changing the display image according to the viewer's positions, the change of the display image may be undesirably recognized to the viewer so that the display quality may be unsatisfactory. In addition, if the position of the viewer is not precisely tracked, a crosstalk may be generated.

BRIEF SUMMARY OF THE INVENTION

In one or more embodiments of a three-dimensional ("3D") image display apparatus according to the present invention, the display apparatus includes a display panel, a light controlling element, a position detecting pan and a display panel driver. The display panel includes a plurality of subpixels. A first group of two subpixels displays right image for a right eye of a viewer and a second group of two subpixels adjacent to the first group in a first direction displays a left image for a left eye of the viewer. The light controlling element transmits an image on one subpixel to one viewpoint in the first direction. The light controlling element has four viewpoints. The position detecting part detects a position of the viewer. The display panel driver switches the right image and the left image according to the position of the viewer.

In one or more embodiments, a proper distance from the light controlling element for the 3D image may be defined as a distance at which a width of a viewpoint image concentrated at each viewpoint through the light controlling element is substantially equal to a half of a distance of two eyes of the viewer. At the proper distance, the display panel driver may switch the right image and the left image of the subpixel when the viewer moves by a half of the distance between two eyes of the viewer.

In one or more embodiments, a first subpixel and a second subpixel adjacent to the first subpixel may display the right image. A third subpixel adjacent to the second subpixel and a fourth subpixel adjacent to the third subpixel may display the left image. When a luminance of the image on the first subpixel of the display panel shown to the right eye of the viewer becomes less than a luminance of the image on the third subpixel as the viewer moves in the first direction, the first subpixel may display the left image and the third subpixel may display the right image.

In one or more embodiments, the light controlling element may be a barrier module having a transmitting portion and a blocking portion or a lenticular lens module including a plurality of lenticular lenses.

In one or more embodiments, the barrier module may include a plurality of unit barriers. The unit barrier may correspond to four subpixels. A ratio between a width of the transmitting portion in the first direction and a width of the blocking portion in the first direction in the unit barrier may be about 1:3.

In one or more embodiments, the transmitting portion of the light controlling element may be shifted by a half of a pitch of the unit barrier in the first direction in each frame.

In one or more embodiments, the transmitting portion and the blocking portion of the light controlling element may have stripe patterns.

In one or more embodiments, a proper distance from the light controlling element for the 3D image may be defined as a distance at which a width of a viewpoint image concentrated at each viewpoint through the light controlling element is substantially equal to a half of a distance of two eyes of the viewer. When a viewing distance of the viewer is greater than the proper distance, one of positions of the right eye and the left eye of the viewer may be set as a base position. A viewed image may be divided into a plurality of viewpoint areas based on the base position.

In one or more embodiments, a width of the viewpoint area k may be $$k = \frac{hE}{2(h-d)}$$

when the viewing distance of the viewer is greater than the proper distance. h is the viewing distance of the viewer, d is the proper distance and E is the distance of two eyes of the viewer.

In one or more embodiments, when the base position is the position of the right eye, a first area may be defined as an area corresponding to the viewpoint area in a right viewed image. Two subpixels corresponding to two viewpoints defining the closest viewpoint area boundary may display right images in the first area. Two subpixels corresponding to two viewpoints not defining the closest viewpoint area boundary may display left images in the first area.

In one or more embodiments, a proper distance from the light controlling element for the 3D image may be defined as a distance at which a width of a viewpoint image concentrated at each viewpoint through the light controlling element is substantially equal to a half of a distance of two eyes of the viewer. When a viewing distance of the viewer is less than the proper distance, one of positions of the right eye and the left eye of the viewer may be set as a base position. A viewed image may be divided into a plurality of viewpoint areas based on the base position.

In one or more embodiments, a width of the viewpoint area k may be $$k = \frac{mE}{2(d-m)}$$

when the viewing distance of the viewer is less than the proper distance. m is the viewing distance of the viewer, d is the proper distance and E is the distance of two eyes of the viewer.

In one or more embodiments, when the base position is the position of the right eye, a first area may be defined as an area corresponding to the viewpoint area in a right viewed image. Two subpixels corresponding to two viewpoints defining the closest viewpoint area boundary may display right images in the first area. Two subpixels corresponding to two viewpoints not defining the closest viewpoint area boundary may display left images in the first area.

In one or more embodiments of a 3D image display apparatus according to the present invention, the display apparatus includes a display panel, a light controlling element, a position detecting part and a display panel driver. The display panel includes a plurality of subpixels. The display panel alternately displays two right images for a right eye of a viewer and one left image for a left eye of the viewer in a first direction or alternately displaying two left images for the left eye of the viewer and one right image for the right eye of the viewer in the first direction. The light controlling element transmits an image on one subpixel to one viewpoint in the first direction. The light controlling element has three viewpoints. The position detecting part detects a position of the viewer. The display panel driver switches the right image and the left image according to the position of the viewer.

In one or more embodiments, a proper distance from the light controlling element for the 3D image may be defined as a distance at which a width of a viewpoint image concentrated at each viewpoint through the light controlling element is substantially equal to ⅔ of a distance of two eyes of the viewer. At the proper distance, the display panel driver may switch the right image and the left image of the subpixel when the viewer moves by ⅓ of the distance between two eyes of the viewer.

In one or more embodiments, a proper distance from the light controlling element for the 3D image may be defined as a distance at which a width of a viewpoint image concentrated at each viewpoint through the light controlling element is substantially equal to ⅔ of a distance of two eyes of the viewer. Three proper distance viewpoint areas may be disposed between two eyes of the viewer. A switching boundary of the viewpoint may be formed at a central point of a center of the proper distance viewpoint area and a boundary between the proper distance viewpoint areas. At the proper distance, when the right eye of the viewer is close to the center of a first proper distance viewpoint area, a subpixel corresponding to the first proper distance viewpoint area may display the right image. At the proper distance, when the right eye of the viewer is close to the boundary of the first proper distance viewpoint area and a second proper distance viewpoint area, two subpixels corresponding to the first and second proper distance viewpoint areas may display the right image.

In one or more embodiments, the light controlling element may be a barrier module having a transmitting portion and a blocking portion or a lenticular lens module including a plurality of lenticular lenses.

In one or more embodiments, the barrier module may include a plurality of unit barriers. The unit barrier may correspond to three subpixels. A ratio between a width of the transmitting portion in the first direction and a width of the blocking portion in the first direction in the unit barrier may be about 1:2.

In one or more embodiments, the transmitting portion of the light controlling element may be shifted by a half of a pitch of the unit barrier in the first direction in each frame.

In one or more embodiments, the transmitting portion and the blocking portion of the light controlling element may have matrix patterns.

In one or more embodiments, the transmitting portion corresponding to a second pixel row may be shifted by a width of the subpixel in the first direction from a position of the transmitting portion corresponding to a first pixel row.

In one or more embodiments, the transmitting portion corresponding to a second pixel row may be shifted by 1.5 times of a width of the subpixel in the first direction from a position of the transmitting portion corresponding to a first pixel row. The transmitting portion corresponding to a third pixel row may be shifted by the width of the subpixel in the first direction from a position of the transmitting portion corresponding to the first pixel row.

In one or more embodiments, a proper distance from the light controlling element for the 3D image may be defined as a distance at which a width of a viewpoint image concentrated at each viewpoint through the light controlling element is substantially equal to ⅔ of a distance of two eyes of the viewer. When a viewing distance of the viewer is greater than the proper distance, one of positions of the right eye and the left eye of the viewer may be set as a base position. A viewed image may be divided into a plurality of viewpoint areas based on the base position.

In one or more embodiments, a width of the viewpoint area k may be $$k = \frac{hE}{3(h-d)}$$

when the viewing distance of the viewer is greater than the proper distance. h is the viewing distance of the viewer, d is the proper distance and E is the distance of two eyes of the viewer.

In one or more embodiments, when the base position is the position of the right eye, a first area may be defined as an area corresponding to the viewpoint area in a right viewed image. When the first area is closer to a center of a first viewpoint area than a boundary between the first viewpoint area and a second viewpoint area, a subpixel corresponding to the first viewpoint area may display the right image at the first area, two subpixels not corresponding to the first viewpoint area may display the left image at the first area. When the first area is closer to the boundary between the first viewpoint area and the second viewpoint area than the center of a first viewpoint area, subpixels corresponding to the first and second viewpoint areas may display the right image at the first area, one subpixel not corresponding to the first and second viewpoint areas may display the left image at the first area.

In one or more embodiments, a proper distance from the light controlling element for the 3D image may be defined as a distance at which a width of a viewpoint image concentrated at each viewpoint through the light controlling element is substantially equal to ⅔ of a distance of two eyes of the viewer. When a viewing distance of the viewer is greater than the proper distance, one of positions of the right eye and the left eye of the viewer may be set as a base position. A viewed image may be divided into a plurality of viewpoint areas based on the base position.

In one or more embodiments, a width of the viewpoint area k may be $$k = \frac{mE}{3(d-m)}$$

when the viewing distance of the viewer is less than the proper distance. m is the viewing distance of the viewer, d is the proper distance and E is the distance of two eyes of the viewer.

In one or more embodiments, when the base position is the position of the right eye, a first area may be defined as an area corresponding to the viewpoint area in a right viewed image. When the first area is closer to a center of a first viewpoint area than a boundary between the first viewpoint area and a second viewpoint area, a subpixel corresponding to the first viewpoint area may display the right image at the first area, two subpixels not corresponding to the first viewpoint area may display the left image at the first area. When the first area is closer to the boundary between the first viewpoint area and the second viewpoint area than the center of a first viewpoint area, subpixels corresponding to the first and second viewpoint areas may display the right image at the first area, one subpixel not corresponding to the first and second viewpoint areas may display the left image at the first area.

One or more embodiments of the present invention may be related to a display apparatus for enabling a viewer to perceive an image, such as a three-dimensional ("3D") image. The viewer may have a right eye and a left eye, the right eye having a right pupil, the left eye having a left pupil, a pupil distance being a distance between the right pupil and the left pupil. The display apparatus may include a display panel including a plurality of subpixels, the plurality of subpixels including a first subpixel, a second subpixel immediately neighboring the first subpixel, a third subpixel immediately neighboring the second subpixel, a fourth subpixel immediately neighboring the third subpixel, and a fifth subpixel immediately neighboring the fourth subpixel. The display apparatus may further include a position detecting part configured to detect a user location related to the viewer. The user location related to the viewer may be one or more of the location of the right eye, the location of the left eye, the location of the right pupil, and the location of the left pupil. The display apparatus may further include a light controlling element including a first transmitting portion and a second transmitting portion and configured for transmitting light provided from one or more of the subpixels toward one or more of the right eye and the left eye. The display apparatus may further include a display panel driver configured to change subpixel-eye association for at least one of the first subpixel, the second subpixel, the third subpixel, the fourth subpixel, and the fifth subpixel in response to a change of the user location detected by the position detecting part. The subpixel-eye association for a subpixel may represent whether the image component displayed by the subpixel is configured for the right eye or the left eye of the viewer, i.e., whether the image component displayed by the subpixel is a right image component (or right-eye image component) or a left image component (or left-eye image component). Advantageously, the display apparatus may enable the viewer to perceive 3D images with satisfactory quality even if the view moves with respect to the display apparatus.

In one or more embodiments, the display panel driver is configured to associate the third subpixel with the left eye when the location is a first position, the display panel driver is configured to associate the third subpixel with the right eye when the location is a second position, and a distance between the first position and the second position is equal to a half of the pupil distance.

In one or more embodiments, the display panel driver is configured to associate the fourth subpixel with the left eye when the location is the first position, and the display panel driver is configured to associate the fourth subpixel with the left eye when the location is the second position.

In one or more embodiments, the display panel driver is configured to associate the fifth subpixel with the right eye when the location is the first position, and the display panel driver is configured to associate the fifth subpixel with the left eye when the location is a second position.

In one or more embodiments, the second transmitting portion is configured to transmit a first light provided from the fifth subpixel toward the right eye when the location is the first position, and the first transmitting portion is configured to transmit a second light provided from the fifth subpixel toward the left eye when the location is the second position.

In one or more embodiments, the display panel driver is configured to change subpixel-eye association for each of the first subpixel and the third subpixel when a luminance provided by the first subpixel as perceived by the right eye becomes less than a luminance provided by the third subpixel as perceived by the right eye.

In one or more embodiments, the light controlling element further includes a blocking portion disposed between the first transmitting portion and the second transmitting portion, and a width of the blocking portion is three times a width of the first transmitting portion.

In one or more embodiments, the first transmitting portion is at a first position when the display apparatus displays a first frame of a set of images, the first transmitting portion is at a second position when the display apparatus displays a second frame of the set of images, and the second position is equivalent to a result of a shift from the first position by two times a width of the first transmitting portion.

In one or more embodiments, the display panel driver is configured to associate the third subpixel and the fourth subpixel with the left eye for the first frame, and the display panel driver is configured to associate the third subpixel and the fourth subpixel with the right eye for the second frame.

In one or more embodiments, the first transmitting portion is configured to transmit a first light provided from the third subpixel toward the left eye for the first frame, and the second transmitting portion is configured to transmit a second light provided from the third subpixel toward the right eye for the second frame.

In one or more embodiments, the display panel driver is configured to associate the second subpixel with the left eye when the location is a first position, the display panel driver is configured to associate the second subpixel with the right eye when the location is a second position, and a distance between the first position and the second position is equal to a third of the pupil distance.

In one or more embodiments, the display panel driver is configured to associate the third subpixel with the left eye when the location is the first position, the display panel driver is configured to associate the fourth subpixel with the right eye when the location is the first position, the display panel driver is configured to associate the third subpixel with the left eye when the location is the second position, and the display panel driver is configured to associate the fourth subpixel with the right eye when the location is the second position.

In one or more embodiments, the light controlling element further includes a first blocking portion disposed between the first transmitting portion and the second transmitting portion, and wherein a width of the first blocking portion is two times a width of the first transmitting portion.

In one or more embodiments, the first transmitting portion, the first blocking portion, and the second transmitting portion are aligned in a first direction; the light controlling element further includes a third transmitting portion, a fourth transmitting portion, and a second blocking portion; the second blocking portion is disposed between the third a transmitting portion and the fourth transmitting portion; a width of the third transmitting portion is equal to the width of the first transmitting portion; a width of the second blocking portion is equal to the width of the first blocking portion, and the third transmitting portion abuts the first blocking portion.

In one or more embodiments, a boundary of the third transmitting portion and a boundary of the first blocking portion are aligned in a second direction, the second direction being substantially perpendicular to the first direction; the third transmitting portion and a first half of the first blocking portion are aligned in the second direction; and a first half of the second blocking portion and a second half of the first blocking portion are aligned in the second direction.

In one or more embodiments, a center of the third transmitting portion and a center of the first blocking portion are aligned in a second direction, the second direction being substantially perpendicular to the first direction; and a center of the second blocking portion and a center of the second transmitting portion are aligned in the second direction.

In one or more embodiments, the first transmitting portion is at a first position when the display apparatus displays a first frame of a set of images, the first transmitting portion is at a second position when the display apparatus displays a second frame of the set of images, and the second position is equivalent to a result of a shift from the first position by 1.5 times a width of the first transmitting portion.

In one or more embodiments, the display panel driver is configured to associate the fourth subpixel with the left eye for the first frame, and the display panel driver is configured to associate the fourth subpixel with the right eye for the second frame.

In one or more embodiments, the first transmitting portion is configured to transmit a first light provided from the fourth subpixel toward the left eye for the first frame, and the second transmitting portion is configured to transmit a second light provided from the fourth subpixel toward the right eye for the second frame.

In one or more embodiments, the first transmitting portion is configured to transmit a third light provided from the third subpixel toward the right eye for the first frame, and the first transmitting portion is configured to transmit a fourth light provided from the third subpixel toward the left eye for the second frame.

According to embodiments of the invention, a display panel driver may properly change the image components displayed by the display panel according to the position of the viewer so that the display apparatus may enable a viewer to perceive a 3D image even if the viewer moves with respect to the display apparatus. The change of the image components performed for accommodating the movement of the viewer may not be substantially conspicuous to the viewer. Crosstalk also may be prevented so that a display quality of the 3D image may be improved.

BRIEF DESCRIPTION OF THE DRAWINGS

The above and other features and advantages of the present invention will become more apparent by describing in detailed embodiments thereof with reference to the accompanying drawings, in which:

FIG. 9 is a diagram illustrating a subpixel rendering method of the display panel illustrated in FIG. 1 when the actual viewing distance is greater than the proper distance;

DETAILED DESCRIPTION OF THE INVENTION

Hereinafter, embodiments of the present invention will be described in further detail with reference to the accompanying drawings. Although the terms first, second, third etc. may be used herein to describe various signals, elements, components, regions, layers, and/or sections, these signals, elements, components, regions, layers, and/or sections should not be limited by these terms. These terms may be used to distinguish one signal, element. component, region, layer, or section from another signal, region, layer or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms first, second, third etc. may also be used herein to differentiate different categories of elements. For conciseness, the terms first, second, third, etc. may represent first-category, second-category, third-category, etc., respectively.

Various embodiments are described herein below, including methods and techniques. Embodiments of the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

In some portions of the specification, the terms "right image RI", "right images RI", "right image RI components", and "right image components RI" may be used; the terms "left image LI", "left images LI", "left image LI components", and "left image components LI" may be used interchangeably. In some portions of the specification, the term "eye" may represent "eye pupil". In the specification "display a 3D image" may mean "enable perception of a 3D image" or "enable a viewer to perceive a 3D image".

Figure 1:
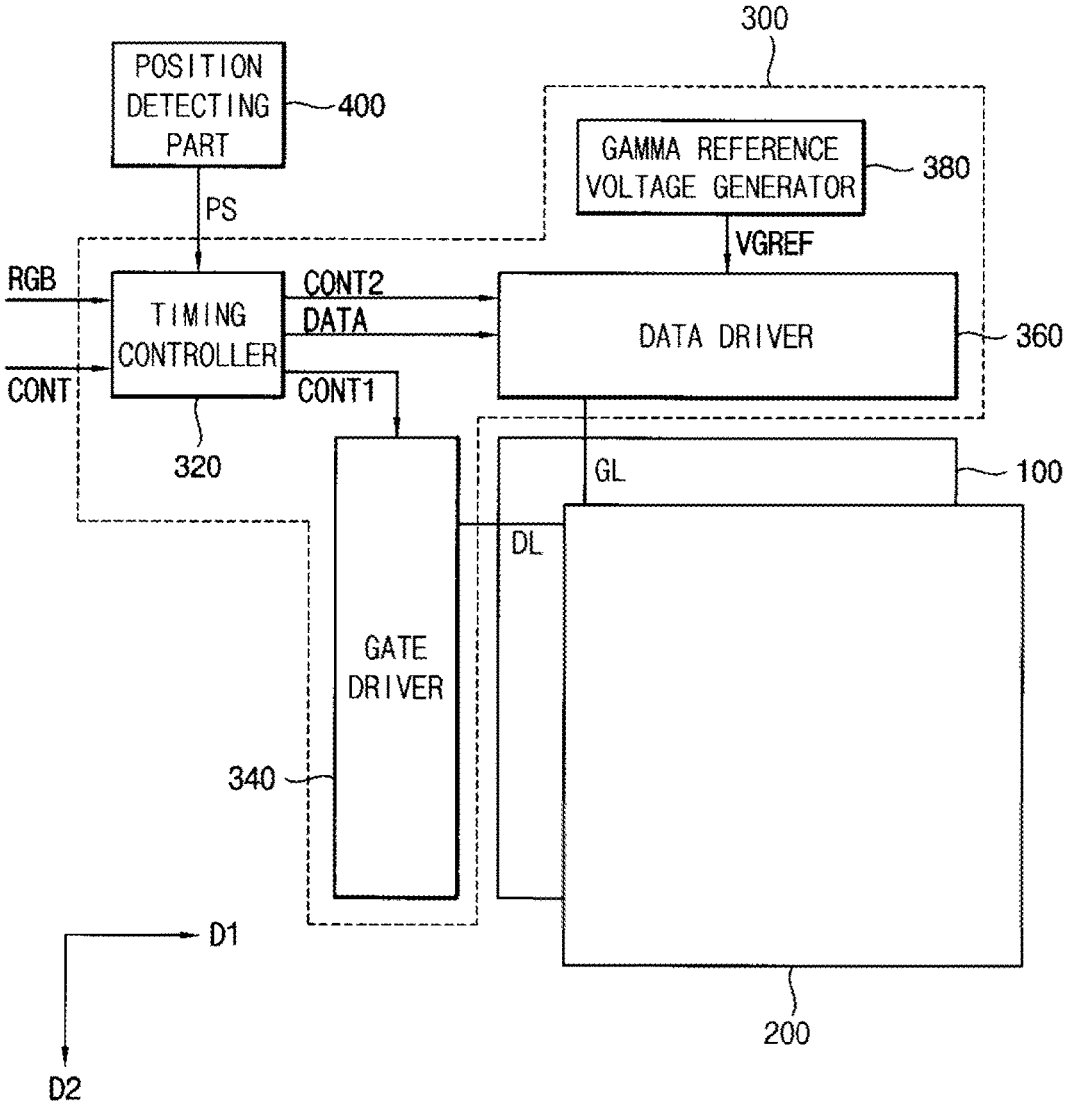
FIG. 1 is a block diagram illustrating a display apparatus according to one or more embodiments of the present invention.

FIG. 1 is a block diagram illustrating a display apparatus according to one or more a embodiments of the present invention.

Referring to FIG. 1, the display apparatus includes a display panel 100, a light controlling element 200, a display panel driver 300, and a position detecting part 400.

The display panel 100 may display an image. The display panel 100 may include a first substrate, a second substrate overlapping the first substrate, and a liquid crystal layer disposed between the first substrate and the second substrate.

The display panel 100 includes a plurality of pixels. Each pixel includes a plurality of subpixels. For example, each pixel may include a red subpixel, a green subpixel, and a blue subpixel.

The display panel 100 includes a plurality of gate lines GL and a plurality of data lines DL. The subpixels are connected to the gate lines GL and the data lines DL. The gate lines GL extend in a first direction D1. The date lines DL extend in a second direction D2 substantially perpendicular to the first direction D1.

Each subpixel includes a switching element and a liquid crystal capacitor electrically connected to the switching element. The subpixel may further include a storage capacitor. The subpixels are disposed in a matrix form. The switching element may be a thin film transistor.

The gate lines GL, the data lines DL, pixel electrodes, and storage electrodes may be disposed on the first substrate. A common electrode may be disposed on the second substrate.

The light controlling element 200 is disposed on the display panel 100. The light controlling element 200 may enable a two-dimensional ("2D") image displayed by the display panel 100 to be perceived as a three-dimensional ("3D") image by a viewer. For example, the light controlling element 200 may transmit an image displayed by a subpixel of the display panel 100 to a plurality of viewpoints.

A pixel structure of the display panel 100 and a configuration of the light controlling element 200 are further discussed with reference to FIGS. 4 to 6.

In one or more embodiments, the light controlling element 200 may include or (or may be) a barrier module including a transmitting portion and a blocking portion. The barrier module may selectively block light associated with the image displayed by the subpixel of the display panel 100 and may transmit the remaining light associated with the image to the viewpoints.

In one or more embodiments, the light controlling element 200 may include a plurality of lenticular lenses. The lenticular lenses may refract the remaining light associated with the image to the viewpoints.

In one or more embodiments, the light controlling element 200 may include (or may be) a switchable barrier module that is operated according to an operating mode of the display apparatus, which may be a 2D mode or a 3D mode. For example, the light controlling element 200 may be a liquid crystal barrier module. The switchable barrier module may be turned on or off according to the operating mode. For example, the switchable barrier module may be turned off in the 2D mode so that the display apparatus displays a 2D image. The switchable barrier module may be turned on in the 3D mode so that the display apparatus displays a 3D image.

The switchable barrier module may include a first barrier substrate, a second barrier substrate overlapping the first barrier substrate, and a barrier liquid crystal layer disposed between the first barrier substrate and the second barrier substrate.

In one or more embodiments, the light controlling element 200 may include (or may be) a switchable lens module that is operated according to an operating mode of the display apparatus, which may be a 2D mode or a 3D mode. For example, the light controlling element 200 may be a liquid crystal lens module. The switchable lens module is turned on a or off according to the operating mode. For example, the switchable lens module may be turned off in the 2D mode so that the display apparatus displays a 2D image. The switchable lens module may be turned on in the 3D mode so that the display apparatus displays (or enables perception of) a 3D image.

The switchable lens module may include a first lens substrate, a second lens substrate overlapping the first lens substrate, and a lens liquid crystal layer disposed between the first lens substrate and the second lens substrate.

In one or more embodiments, the light controlling element 200 may include a plurality of prisms for changing one or more paths of the light associated with an image displayed by the display panel 100). In one or more embodiments, the light controlling element 200 may include a holographic element for changing one or more paths of the light.

The display panel driver 300 is connected to the display panel 100 to drive the display panel 100. The display panel driver 300 may include a timing controller 320, a gate driver 340, a data driver 360, and a gamma reference voltage generator 380.

The timing controller 320 may receive input image data RGB and an input control signal CONT from an external apparatus. The timing controller 320 may receive a position signal PS from the position detecting part 400. The input image data RGB may include red image data R, green image data G, and blue image data B. The input control signal CONT may include a master clock signal, a data enable signal, a vertical synchronizing signal, and a horizontal synchronizing signal.

The timing controller 320 may generate a first control signal CONT1, a second control signal CONT2, and a data signal DATA based on the input image data RGB, the input control signal CONT, and the position signal PS.

The timing controller 320 may generate the first control signal CONT1 to control a driving timing of the gate driver 340 based on the input control signal CONT and may output the first control signal CONT1 to the gate driver 340. The first control signal CONT1 may include a vertical start signal and a gate clock signal.

The timing controller 320 may generate the second control signal CONT2 to control a driving timing of the data driver 360 based on the input control signal CONT and may output the second control signal CONT2 to the data driver 360. The second control signal CONT2 may include a horizontal start signal and a load signal.

The timing controller 320 may generate the data signal DATA based on the input image data RGB and the position signal PS and may output the data signal DATA to the data driver 360.

The gate driver 340 may receive the first control signal CONT1 from the timing controller 320. The gate driver 340 may generate gate signals in response to the first control signal CONT1. The gate driver 340 may sequentially output the gate signals to the gate lines GL.

The gamma reference voltage generator 380 may generate a gamma reference voltage VGREF. The gamma reference voltage generator 380 may provide the gamma reference voltage VGREF to the data driver 360. The gamma reference voltages VGREF may have values corresponding to the data signal DATA.

The gamma reference voltage generator 380 may include a resistor string circuit having a plurality of resistors connected in series for dividing a source voltage and a ground voltage to generate the gamma reference voltage VGREF. In one or more embodiments, the gamma reference voltage generator 380 may be disposed in the data driver 360.

The data driver 360 may receive the second control signal CONT2 and the data signal DATA from the timing controller 320. The data driver 360 may receive the gamma reference voltage VGREF from the gamma reference voltage generator 380.

The data driver 360 may convert the data signal DATA into analog data voltages using the gamma reference voltage VGREF. The data driver 360 may output the data voltages to the data lines DL.

Although not shown in figures, the display panel driver 300 may further include a frame rate converter connected to the timing controller 320 for converting a frame rate of the input image data RGB.

An operation and a structure of the display panel driver 300 are further discussed with reference to FIG. 7.

The position detecting part 400 may detect a position of a viewer and may accordingly generate the position signal PS. The position detecting part 400 may output the position signal PS to the timing controller 320. In one or more embodiments, the position detecting part 400 may detect positions of two eyes of the viewer. In one or more embodiments, the position detecting part 400 may determine a distance between the two eyes of the viewer. In one or more embodiments, the position detecting part 400 may detect a position of one of the eyes of the viewer.

In one or more embodiments, the position detecting part 400 may include a camera. In one or more embodiments, the position detecting part 400 may include an infrared sensor. The position detecting part 400 may be disposed in a bezel portion of the display apparatus (or of the display panel 100).

Figure 2A:
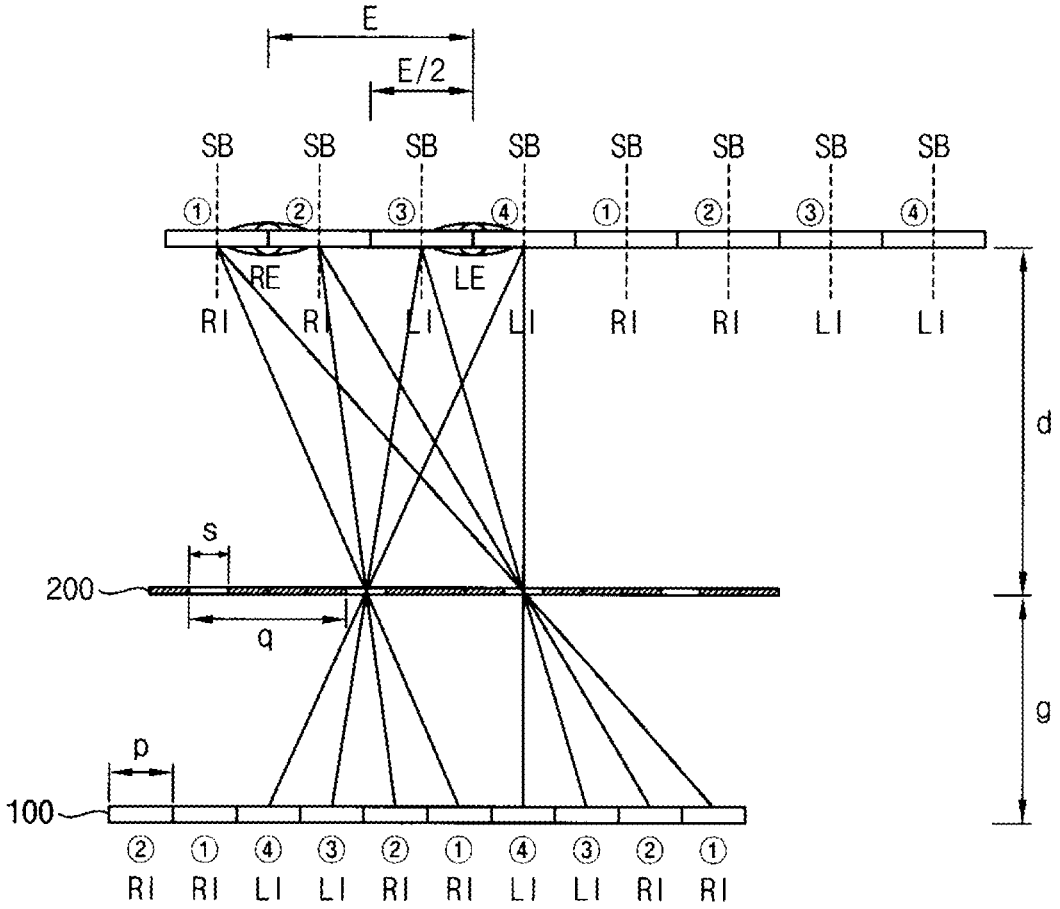
FIG. 2A is a diagram illustrating a method of displaying (or enabling perception of) a three-dimensional ("3D") image using a display panel and a light controlling element illustrated in FIG. 1 when a viewer is positioned at a proper distance from the light controlling element for the 3D image, i.e., when the viewer's eyes (or pupils) are positioned at a proper imaginary geometric plane that is substantially parallel to the display panel and the light controlling element.
Figure 2B:
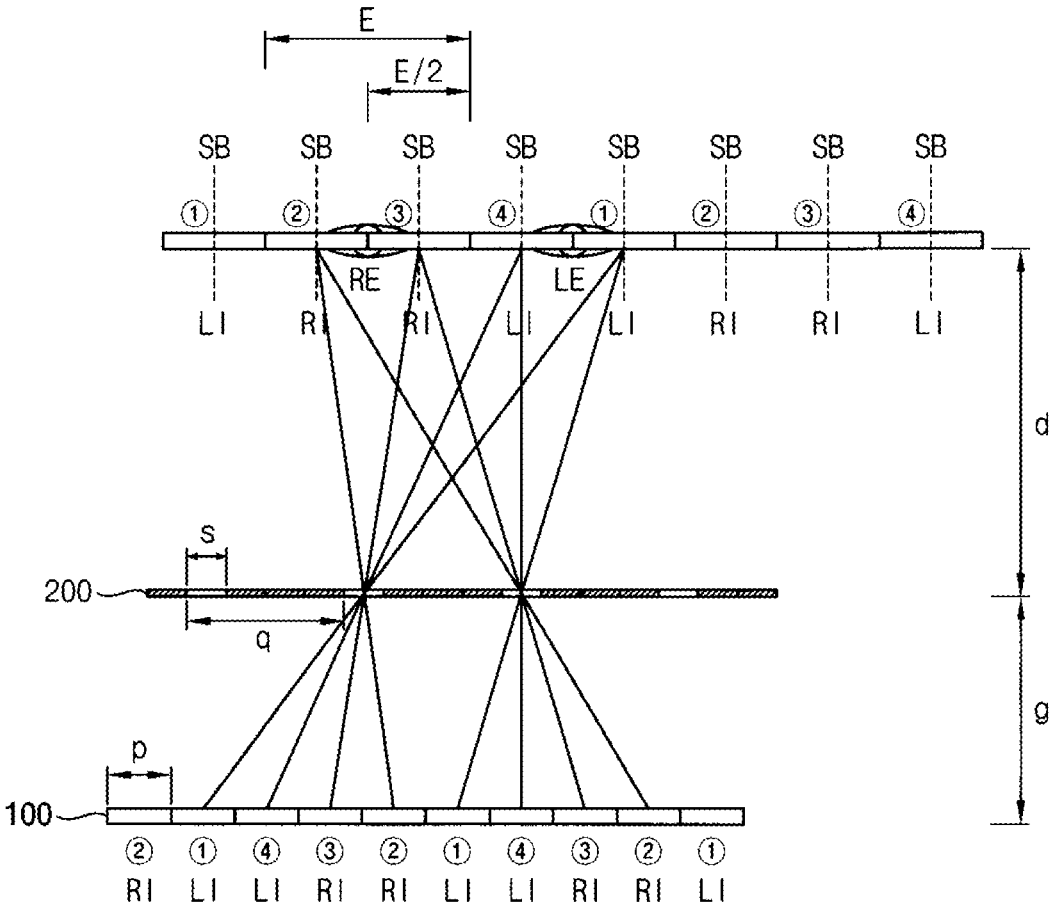
FIG. 2B is a diagram illustrating a method of displaying (or enabling perception of) the 3D image using the display panel and the light controlling element illustrated in FIG. 1 when the viewer moves to a new position while keeping at the proper distance from the light controlling element, i.e., when the viewer moves while the viewer's eyes remain at the proper plane.
Figure 3:
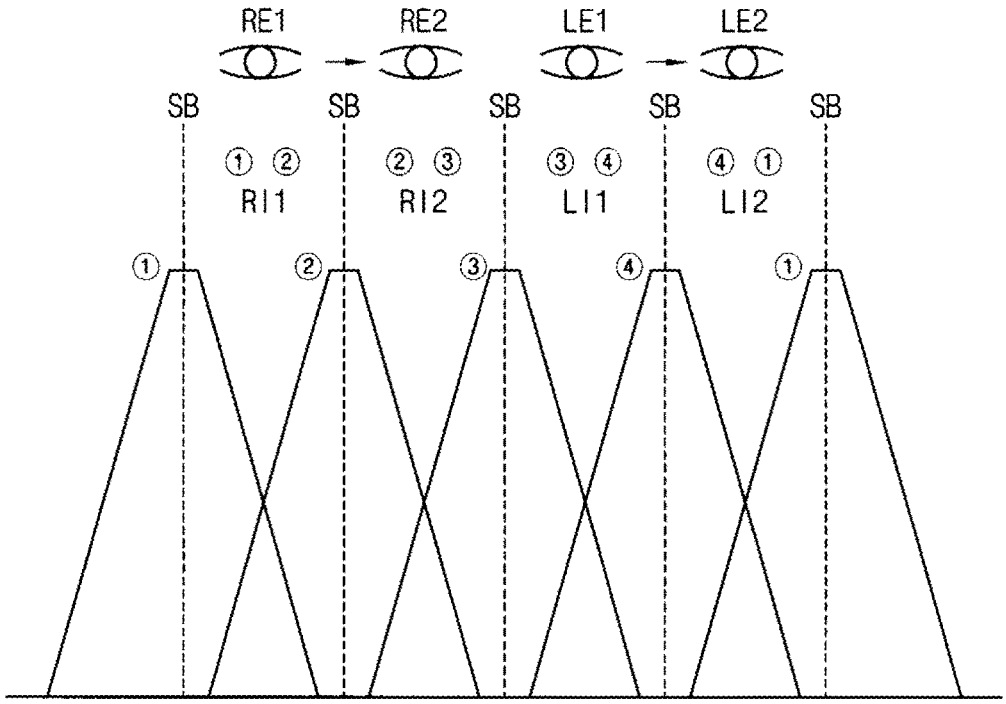
FIG. 3 is a graph illustrating luminances of viewpoint images corresponding to subpixels of the display panel of FIG. 1 when the viewer moves while keeping at the proper distance from the light controlling element, i.e., when the viewer moves while the viewer's eyes remain at the proper plane.

FIG. 2A is a diagram illustrating a method of displaying (or enabling perception of) the 3D image using the display panel 100 and the light controlling element 200 illustrated in FIG. 1 when the viewer is positioned at a proper distance from the light controlling element 200 for the 3D image, i.e., when the viewer's eyes (or pupils) are positioned at a proper imaginary geometric plane that is substantially parallel to the display panel and the light controlling element. The proper plane is marked with FIG. 2B is a diagram illustrating a method of displaying (or enabling perception of) the 3D image using the display panel 100 and the light controlling element 200 illustrated in FIG. 1 when the viewer moves to a new position while keeping at the proper distance, i.e., when the viewer moves while the viewer's eyes remain at the proper plane. In FIG. 2A and FIG. 2B, the proper plane is spaced from the display panel 10 and is marked with viewpoints (1), (2), (3), and (4), i.e., circle 1, circle 2, circle 3, and circle 4 shown in FIG. 2A and FIG. 2B. FIG. 3 is a graph illustrating luminances of viewpoint images corresponding to subpixels of the display panel 100 of FIG. 1 when the viewer moves while keeping at the proper distance.

Referring to FIGS. 1 to 3, the light controlling element 200 may overlap (and may be disposed on) the display panel 100. In one or more embodiments, the light controlling element 200 may include a barrier module, as illustrated in FIGS. 2A and 2B. In one or more embodiments, the light controlling element 200 may include a lenticular lens module.

The display panel 100 includes a plurality of the subpixels. Images displayed by the subpixels of the display panel 100 may be repeated in four-subpixel sets each including four subpixels. Among the four subpixels in a four-subpixel set, two subpixels may display right images RI (or right-eye image components RI) for a right eye RE of the viewer, and the other two subpixels may display left images LI (or left-eye image components LI) for a left eye LE of the viewer. For example, the first subpixel and the second subpixel (which may from a first group) may display the right images RI, the third subpixel and the fourth subpixel (which may form a second group adjacent to the first group) may display the left images LI, the fifth subpixel and the sixth subpixel (which may form a third group adjacent to the second group) may display the right images RI, and the seventh subpixel and the eighth subpixel (which may form a fourth group adjacent to the third group) may display the left images LI.

The light controlling element 200 may include at least one transmitting portion and at least one blocking portion. An image component displayed on one subpixel may be transmitted to at least a viewpoint through the light controlling element 200. In one or more a embodiments, the light controlling element 200 may be associated with four viewpoints.

In the one or more embodiments, the light controlling element 200 may not move with respective to the display panel 100, i.e. the light controlling element 200 may remain stationary with respect to the display panel 100. In one or more embodiments, the light controlling element 200 may move in a (horizontal) direction parallel to the display panel 100. In one or more embodiments, the transmitting portion of the light controlling element 200 may shift in the direction parallel to the display panel 100. A method of shifting the transmitting portion of the light controlling element 200 in each frame is further discussed with reference to FIGS. 12A and 12B.

An image displayed by a first subpixel of a first four-subpixel set may be transmitted to a first viewpoint (1) (i.e., circle 1 shown in figures) through the light controlling element 200. An image displayed by a second subpixel of the first four-subpixel set (immediately adjacent to the first subpixel) may be transmitted to a second viewpoint (2) (i.e., circle 2 shown in figures) through the light controlling element 200. An image displayed by a third subpixel of the first four-subpixel set (immediately adjacent to the second subpixel) may be transmitted to a third viewpoint (3) (i.e., circle 3 shown in figures) through the light controlling element 200. An image displayed by a fourth subpixel of the first four-subpixel set (immediately adjacent to the third subpixel) may be transmitted to a fourth viewpoint (4) (i.e., circle 4 shown in figures) through the light controlling element 200. An image displayed by a fifth subpixel (i.e., a first subpixel of a second four-subpixel set) immediately adjacent to (the left side of) the fourth subpixel may be transmitted to the first viewpoint (1) through the light controlling element 200. An image displayed by a sixth subpixel (i.e., a second subpixel of the second four-subpixel set) immediately adjacent to the fifth subpixel may be transmitted to the second viewpoint (2) through the light controlling element 200. An image displayed by a seventh subpixel (i.e., a third subpixel of the second four-subpixel set) immediately adjacent to the sixth subpixel may be transmitted to the third viewpoint (3) through the light controlling element 200. An image displayed by an eighth subpixel (i.e., a fourth subpixel of the second four-subpixel set) immediately adjacent to the seventh subpixel may be transmitted to the fourth viewpoint (4) through the light controlling element 200. As illustrated in FIG. 2A, the fifth subpixel, the sixth subpixel, the seventh subpixel, and the eighth subpixel may represent the first subpixel, the second subpixel, the third subpixel, and the fourth subpixel of the second four-subpixel set. The numbering of the viewpoints of a four-viewpoint set may be in a reverse order with respect to the numbering of the subpixels of each corresponding four-subpixel set. In the figures, the RIs and LIs associated with different four-subpixel sets (and/or different subpixels) may respectively represent different components of right-eye images and different components of left-eye images displayed by different four-subpixel sets (and/or different subpixels); the RIs and LIs associated with the eyes of the viewer may respectively represent the combined right-eye image and the combined left-eye image received by the viewer's right eye and left eye, respectively.

In one or more embodiments, a proper distance d for the 3D image is defined as a distance between the viewer (or the viewer's eyes) and the light controlling element 200 at which a width of a viewpoint image (i.e., the range of the light associated with same-eye image components displayed by two immediately neighboring subpixels, transmitted through the light controlling element 200, and received at a viewpoint at the proper plane) is substantially equal to E/2, i.e., a half of a distance E between (the pupils of) two eyes of the viewer. In one or more embodiments, images (i.e., light associated with the images) corresponding to the total width (i.e., sum of widths) of two immediately neighboring subpixels that display the right images RI, e.g., the first subpixel and the second subpixel of the first four-subpixel set, may be (maximally) shown to the right eye RE of the viewer in a range of the E/2 width through a first transmitting portion of the light controlling element 200 at the proper distance d, i.e., when the distance between the viewer and the light controlling element 200 is d. Analogously, images (i.e., light associated with the images) corresponding to the total width (i.e., sum of widths) of two immediately neighboring subpixels that display the left images LI, e.g., the third subpixel and the fourth subpixel of the first four-subpixel set, may be (maximally) shown to the left eye LE of the viewer in a range of the E/2 width through the first transmitting portion of the light controlling element 200 at the proper distance d, i.e., when the distance between the viewer and the light controlling element 200 is d. Analogously, the light associated with the right images and left images displayed by the subpixels in the second four-subpixel set may be transmitted through a second transmitting portion of the light controlling element 200.

If the viewer's eyes are at the proper distance d. i.e., when the distance between the viewer and the light controlling element 200 is d, the display panel driver 300 may switch the right image components RI and the left image components LI displayed by at least some of the subpixels when the viewer has moved in the first direction D1 (indicated in FIG. 1) or in a direction parallel to the first direction D1 by E/2, i.e. a half of the distance E, wherein the distance E may be the distance between (the pupils of) the two eyes of the viewer. Advantageously, the viewer may perceive substantially consistent (3D) images and satisfactory display quality.

In one or more embodiments, if a width of a subpixel (or of each subpixel) in the first direction D1 is p, if a distance between the display panel 100 and the light controlling element 200 is g, if the distance between (the pupils of) the two eyes of the viewer is E, if the proper distance between the proper plane and the light controlling element 200 is d, if a width of a transmitting portion of the light controlling element 200 in the first direction D1 is s, and if a pitch of a unit barrier is q, then the display apparatus may satisfy the following Equations 1 to 5.

$$p: g = \frac{E}{2}: d \quad \text{[Equation 1]}$$

$$d = \frac{Eg}{2p} \quad \text{[Equation 2]}$$

$$d: s = (d + g): p \quad \text{[Equation 3]}$$

-continued $$s = \frac{dp}{(d + g)} \quad \text{[Equation 4]}$$

$$s = \frac{Ep}{(E + 2p)} \quad \text{[Equation 5]}$$

In FIG. 2A, image components displayed by the subpixels (the two first subpixels and the two second subpixels of two four-subpixel sets, a first four-subpixel set and a second four-subpixel set) corresponding to the first viewpoint and the second viewpoint of a first four-viewpoint set are shown to the right eye RE of the viewer through two of the transmitting portions of the light controlling element 200. Analogously, image components displayed by other subpixels corresponding to the first viewpoint and the second viewpoint of the first four-viewpoint set may also be shown to the right eye RE of the viewer through other transmitting portions of the light controlling element 200. The subpixels corresponding to the first viewpoint and the second viewpoint display the right image RI.

Image components displayed by the subpixels (e.g., the two third subpixels and the two fourth subpixels of the two four-subpixel sets) corresponding to the third viewpoint and the fourth viewpoint of the first four-viewpoint set are shown to the left eye LE of the viewer through the two of the transmitting portions of the light controlling element 200. Analogously image components displayed by other subpixels corresponding to the third viewpoint and the fourth viewpoint of the first four-viewpoint set may also be shown to the left eye LE of the viewer through other transmitting portions of the light controlling element 200. The subpixels corresponding to the third viewpoint and the fourth viewpoint display the left images LI.

With reference to the positions of the eyes illustrated in FIG. 2A, FIG. 2B illustrates that the right eye RE and the left eye LE of the viewer have moved by E/2, i.e., a half of the distance E between (the pupils of) the two eyes of the viewer, in the first direction D1. Before the movement, as illustrated in FIG. 2A, the pupil of the right eye RE may be positioned at the boundary of the first viewpoint and the second viewpoint of the first four-viewpoint set, and the pupil of the left eye LE may be positioned at the boundary of the third viewpoint and the fourth viewpoint of the first four-viewpoint set. After the movement, as illustrated in FIG. 2B, the pupil of the right eye RE may be positioned at the boundary of the second viewpoint and the third viewpoint of the first four-viewpoint set, and the pupil of the left eye LE may be positioned at the boundary of the fourth viewpoint of the first four-viewpoint set and the first viewpoint of a second four-viewpoint set.

In response to the movement of the viewer's eyes, image components displayed by the subpixels corresponding to the second viewpoint and the third viewpoint are shown to the right eye RE of the viewer through the transmitting portions of the light controlling element 200. In response to the eye movement, instead of displaying left image components LI (as illustrated in FIG. 2A), the third subpixels of the four-subpixel sets may become displaying right image components RI (as illustrated in FIG. 2B). The subpixels corresponding to the second viewpoint and the third viewpoint display the right image RI.

In response to the movement of the viewer's eyes, as illustrated in FIG. 2B, the first subpixel of the first four-subpixel set and the first subpixel of the second four-subpixel set may become not corresponding to the first four-viewpoint set, and the first subpixel of the second four-subpixel set and the first subpixel of a third four-subpixel set may become corresponding to the first viewpoint of the second four-viewpoint set. Image components displayed by the subpixels corresponding to the fourth viewpoint of the first four-viewpoint set and the first viewpoint of the second four-viewpoint set are shown to the left eye LE of the viewer through at least the two of the transmitting portions of the light controlling element 200. In response to the eye movement, instead of displaying right image components RI, the first subpixels of the four-subpixel sets (including the first four-subpixel set, the second four-subpixel set, and the third four-subpixel set) may become displaying left image components LI. The subpixels corresponding to the fourth viewpoint of the first four-viewpoint set and the first viewpoint of the second four-viewpoint set display the left image LI.

When the right eye RE and the left eye LE of the viewer are respectively located at positions RE1 and LE1 indicated in FIG. 2A, the display panel driver 300 drives the display panel 100 to display (components of) the right image RI on the subpixels corresponding to a first viewpoint and a second viewpoint, e.g., the first viewpoint and the second viewpoint of the first four-viewpoint set, and to display (components of) the left images LI on the subpixels corresponding to a third viewpoint and a fourth viewpoint, e.g., the third viewpoint and the fourth viewpoint of the of the first four-viewpoint set.

When the right eye RE and the left eye LE of the viewer are respectively located at positions RE2 and LE2 indicated in FIG. 2B, the display panel driver 300 drives the display panel 100 to display (components of) the right image RI on the subpixels corresponding to a second viewpoint and a third viewpoint, e.g., the second viewpoint and the third viewpoint of the first four-viewpoint set, and to display (components of) the left image LI on the subpixels corresponding to a fourth viewpoint and a first viewpoint, e.g., the fourth viewpoint of the first four-viewpoint set and the first viewpoint of the second four-viewpoint set.

Therefore, when the right eye RE and the left eye LE of the viewer have moved from the positions RE1 and LE1 indicated in FIG. 2A to the positions RE2 and LE2 indicated in FIG. 28, the display panel driver 300 may replace the right image components RI displayed by the subpixels (i.e., the first subpixels of four-subpixel sets) corresponding to a first viewpoint with left image components LI and may replace the left image LI components displayed by the subpixels (i.e., the third subpixels of four-subpixel sets) corresponding to the third viewpoint with right image components RI.

In one or more embodiments, the light controlling element 200 also may move in the first direction to accommodate the change of images displayed by the subpixels. In one or more embodiments, when the viewer moves in the horizontal direction (i.e., the first direction D1) with respect to the display panel 100, the display apparatus may enable perception of a 3D image using a subpixel rendering method (discussed with reference to FIG. 9, FIG. 11, etc.) without moving the light controlling element 200.

FIG. 3 illustrates luminances of the viewpoint images. i.e., the image components displayed by the subpixels and focused and combined at the respective viewpoints when the distance between the viewer's eyes and the light controlling element 200 is substantially equal to the proper distance d. When the right eye RE of the viewer is located at a first position RE1 in FIG. 2A, the images displayed by the subpixels corresponding to the first viewpoint and the second viewpoint are strongly shown to the right eye RE and are labeled RI1 in FIG. 3.

When the right eye RE of the viewer (gradually) moves from the first position RE1 in FIG. 2A to a second position RE2 in FIG. 2B, as perceived by the right eye RE, a luminance of the image displayed by the subpixel(s) corresponding to the first viewpoint may decrease, and a luminance of the image displayed by the subpixel(s) corresponding to the second viewpoint increases. In addition, as perceived by the right eye RE, a luminance of the image displayed by the subpixel(s) corresponding to the third viewpoint may also increase.

When the right eye RE of the viewer is located at a switching boundary SB between the first position RE1 and the second position RE2 corresponding to a center (or midpoint) between the positions RE1 and RE2, as perceived by the right eye RE, the luminance of the image displayed by the subpixel(s) corresponding to the second viewpoint may reach a maximum value. In addition, as perceived by the right eye RE, the luminance of the image displayed by the subpixel(s) corresponding to the first viewpoint is substantially equal to the luminance of the image displayed by the subpixel(s) corresponding to the third viewpoint.

When the right eye RE of the viewer (gradually) moves from the switching boundary SB between the positions RE1 and RE2 to the second position RE2, as perceived by the right eye RE, the luminance of the image displayed by the subpixel(s) corresponding to the first viewpoint may become lower and lower than the luminance of the image displayed by the subpixel(s) corresponding to the third viewpoint.

When the right eye RE of the viewer (gradually) moves from the first position RE1 in FIG. 2A to the second position RE2 in FIG. 2B, the display panel driver 300 may replace the left image LI displayed by the subpixel(s) corresponding to the third viewpoint with a right image RI when the right eye RE of the viewer is substantially at the switching boundary SB between the positions RE1 and RE2.

When the luminance of the image displayed by the subpixel(s) corresponding to the first viewpoint becomes lower than the luminance of the image displayed by the subpixel(s) corresponding to the third viewpoint at (or as perceived by) the right eye RE of the viewer, the display panel driver 300 may control the display panel 100 to display the left image LI on the subpixels corresponding to the first viewpoint and to display the right image RI on the subpixels corresponding to the third viewpoint. When the right eye RE of the viewer is located at the second position RE2, the right eye RE of the viewer may perceive the right image RI2 displayed by subpixels corresponding to the second viewpoint and the third viewpoint and transmitted through the light controlling element 100.

In an analogous manner, when the left eye LE of the viewer (gradually) moves from a third position LE1 in FIG. 2A to a fourth position LE2 in FIG. 2B, the display panel driver 300 may replace the right image RI displayed by the subpixel(s) corresponding to the first viewpoint with a left image LI when the left eye LE of the viewer is substantially at a switching boundary SB between the positions LE1 and LE2.

At the switching boundary SB (a possible position of the right eye RE of the viewer that corresponds to a change of image-eye association) between the first position RE1 and the second position RE2, the luminances of the images corresponding to the first view point and the luminances of the images corresponding to the third viewpoints have very low values. Thus, although the image components displayed by the subpixels corresponding to the first viewpoint and the third viewpoint switch from left image components LI to right image components RI or from right image components RI to left image components LI when the right eye RE of the viewer is substantially at the switching boundary SB, the viewer may not substantially recognize change of the display image.

In one or more embodiments, in a four-subpixel set, two immediately adjacent subpixels display left image components LI, and two immediately adjacent subpixels display right image components RI. Advantageously, crosstalk may be prevented. Even if the detection of the position of the viewer by the position detecting part 400 is not precise, crosstalk may be substantially reduced or prevented.

Figure 4:
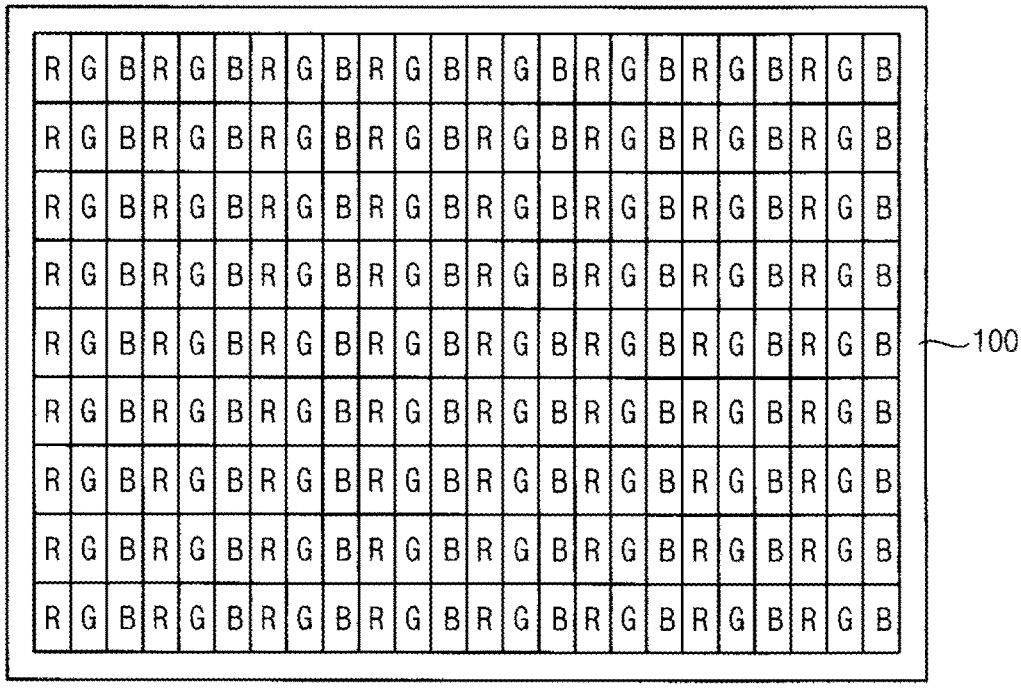
FIG. 4 is a plan view illustrating a pixel structure of the display panel illustrated in FIG. 1.
Figure 5:
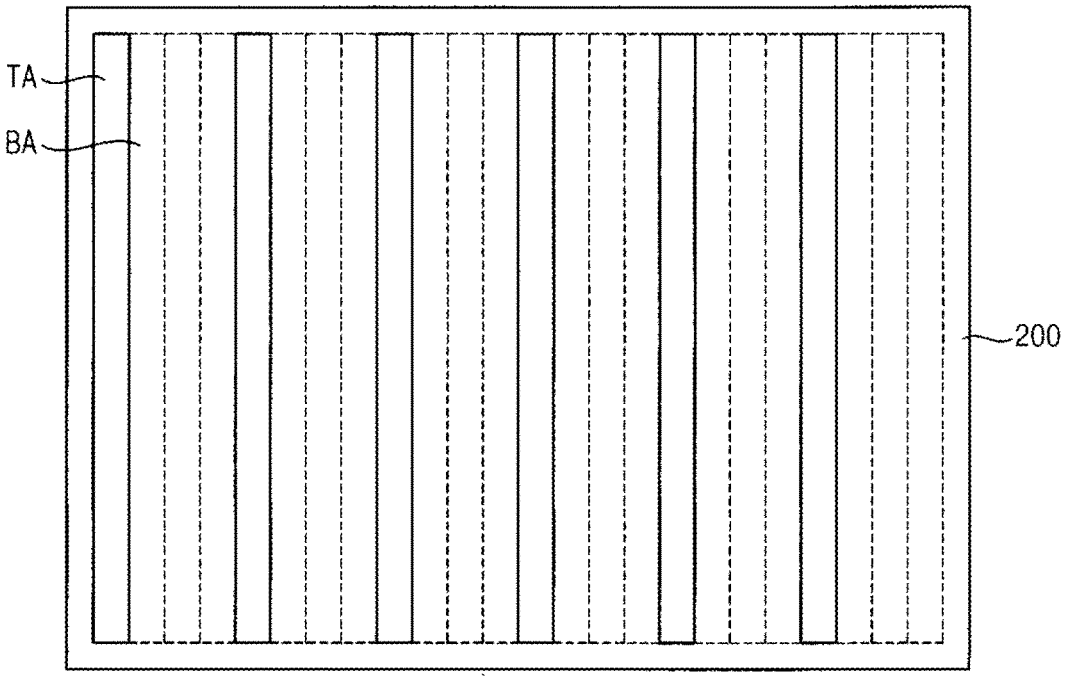
FIG. 5 is a plan view illustrating a configuration of the light controlling element illustrated in FIG. 1.

FIG. 4 is a plan view illustrating a pixel structure of the display panel 100 illustrated in FIG. 1. FIG. 5 is a plan view illustrating a configuration of the light controlling element 200 illustrated in FIG. 1. FIG. 6 is a plan view illustrating an image displayed by the display panel 100 illustrated in FIG. 1 and shown to the viewer through the light controlling element 200 illustrated in FIG. 1 at a viewpoint.

Referring to FIG. 1 and FIGS. 4 to 6, the display panel 100 includes a plurality of pixels. The pixels are disposed in a matrix form.

The pixels include a plurality of subpixels. Each subpixel may have a rectangular configuration. Each subpixel may have a shorter side in the first direction D1 and a longer side in the second direction D2.

The pixels (or a pixel) may include a red subpixel R, a green subpixel G and a blue subpixel B.

As illustrated in FIG. 4, the subpixels R, G and B may be alternately (or sequentially and repeatedly) disposed along the first direction D1 (indicated in FIG. 1). The red subpixels R may be disposed in columns extending in the second direction D2. The green subpixels G may be disposed in columns extending in the second direction D2. The blue subpixels B may be disposed in columns extending in the second direction D2.

In one or more embodiments, the subpixels R, G and B may be alternately (or sequentially and repeatedly) disposed along the second direction D2. Red subpixel rows including red subpixels R, green subpixel rows including green subpixels G, and blue subpixel rows including blue subpixels B may extend in the first direction D1.

In one or more embodiments, the subpixels R. G, and B may be alternately disposed along the first direction D1 and may be alternately disposed along the second direction D2.

The light controlling element 200 may be a barrier module having transmitting portions TA and blocking portions BA. The transmitting portions TA and the blocking portions BA may have stripe patterns. The barrier module includes a plurality of units. Each unit of the plurality of units may correspond to four subpixels and may include a transmitting portion TA and a blocking portions BA. In one or more embodiments, a ratio between a width of the transmitting portion TA in the first direction D1 and a width of the blocking portion BA in the first direction D1 in the unit barrier is about 1:3.

Figure 6:
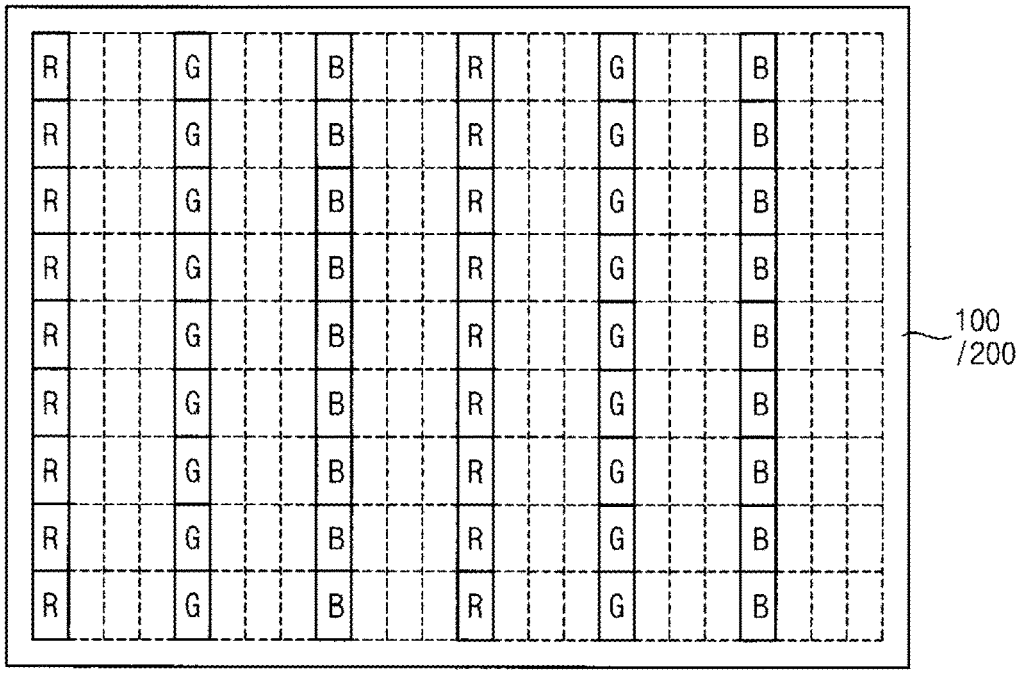
FIG. 6 is a plan view illustrating an image displayed by the display panel illustrated in FIG. 1 and shown to the viewer through the light controlling element illustrated in FIG. 1 at a viewpoint.

At a viewpoint, the subpixels R, G, and B of the display panel 100 are shown to the viewer as illustrated in FIG. 6 through the transmitting portions TA of the light controlling element 200. The subpixels shown to the viewer substantially evenly display the red color, the green color, and the blue color.

Figure 7:
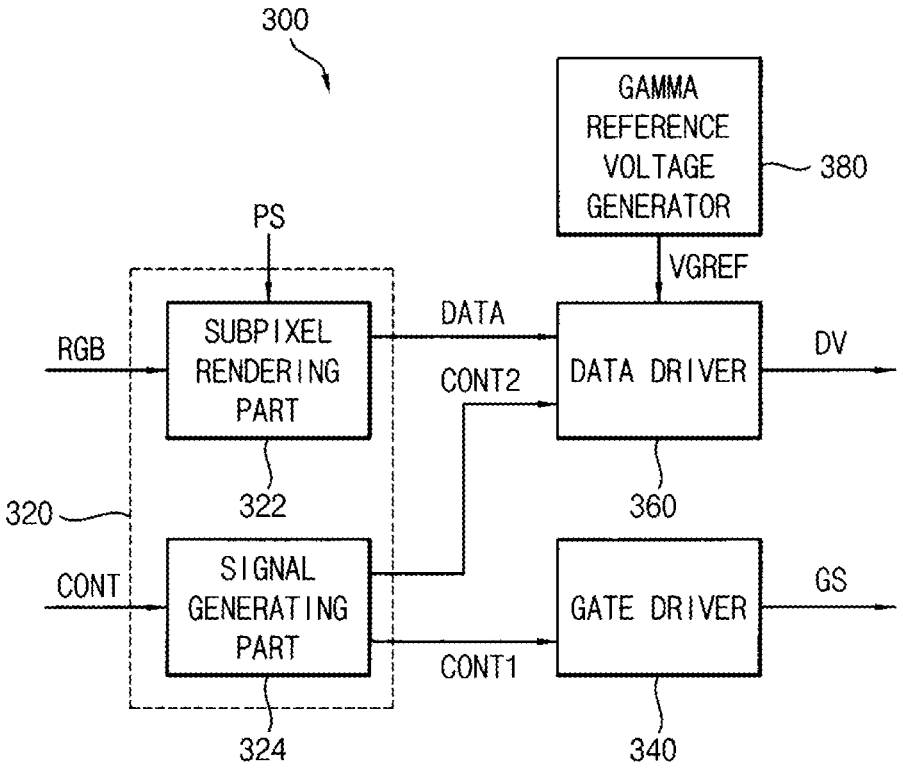
FIG. 7 is a block diagram illustrating a display panel driver illustrated in FIG. 1.

FIG. 7 is a block diagram illustrating the display panel driver 300 illustrated in FIG. 1.

Referring to FIGS. 1 to 7, the display panel driver 300 includes the timing controller 320, the gate driver 340, the data driver 360, and the gamma reference voltage generator 380.

The timing controller 320 includes a subpixel rendering part 322 and a signal generating part 324.

The subpixel rendering part 322 receives the input image data RGB from an external apparatus. The subpixel rendering part 322 receives the position signal PS from an external apparatus (e.g., the position detecting part 400 illustrated in FIG. 1). The input image data RGB may include the red image data R, the green image data G, and the blue image data B.

The subpixel rendering part 322 generates grayscale data DATA for the subpixels based on the input image data RGB and the position signal PS.

At the proper distance d (i.e., if the distance between two viewpoints associated with an image transmitted by two immediately subpixels is substantially equal to a half of the distance E between the two pupils of the viewer), the subpixel rendering part 322 may switch the right image RI and the left image LI displayed by at least two subpixels when the viewer moves by a half of the distance E.

At the proper distance d, the subpixel rendering part 322 may switch the right image RI and the left image LI of the two subpixels when a luminance of an image displayed by a subpixel corresponding to a viewpoint becomes (substantially) greater than a luminance of an image displayed by a subpixel corresponding to an immediately adjacent viewpoint.

The signal generating part 324 may receive the input control signal CONT from an external apparatus. The input control signal CONT may include one or more of a master clock signal, a data enable signal, a vertical synchronizing signal, and a horizontal synchronizing signal.

The signal generating part 324 may generate a first control signal CONT1 for controlling an operation of the gate driver 340) based on the input control signal CONT. The signal generating part 324 outputs the first control signal CONT1 to the gate driver 340. The first control signal CONT1 may include a vertical start signal and a gate clock signal.

The signal generating part 324 may generate a second control signal CONT2 for controlling an operation of the data driver 360 based on the input control signal CONT. The signal generating part 324 may output the second control signal CONT2 to the data driver 360. The second control signal CONT2 may include a horizontal start signal and a load signal.

The timing controller 320 may further include an image compensating part to compensate the grayscale data DATA. The image compensating part may operate an adaptive color correction and a dynamic capacitance compensation to compensate the grayscale data DATA.

The gate driver 340 may receive the first control signal CONT1 from the signal generating part 324. The gate driver 340 may generate gate signals GS to be transmitted through the gate lines of the display panel 100 in response to the first control signal CONT1. The gate driver 340 sequentially may output the gate signals GS to the gate lines GL of the display panel 100.

The data driver 360 may receive the second control signal CONT2 from the signal generating part 324 and may receive the image data DATA from the subpixel rendering part 322. The data driver 360 may receive the gamma reference voltage VGREF from the gamma reference voltage generator 380.

The data driver 360 may convert the image data DATA into analog data voltages DV using the gamma reference voltage VGREF in response to the second control signal CONT2 received from the signal generating part 324. The data driver 360 may output the data voltages DV to the data lines DL of the display panel 100).

Figure 8:
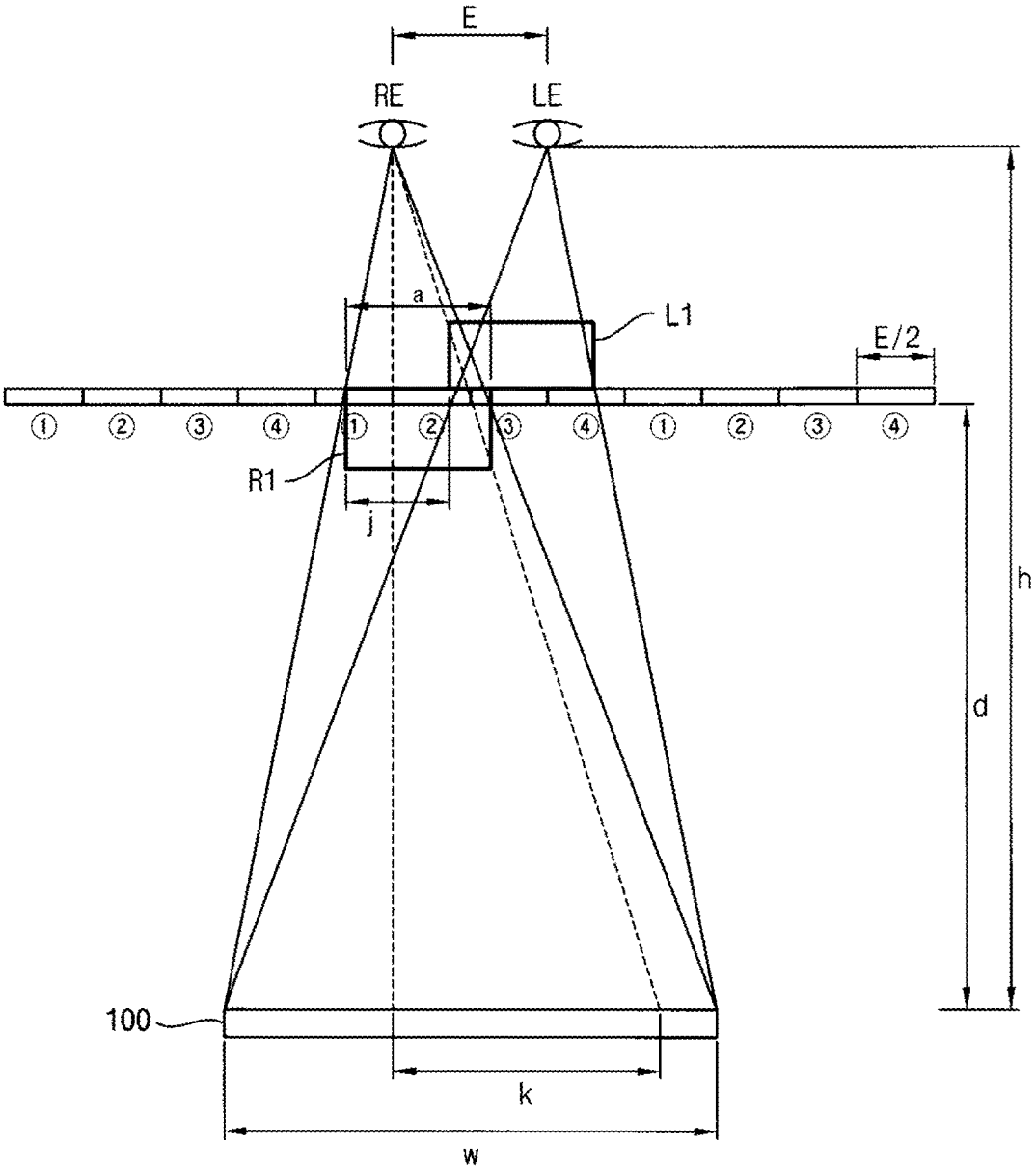
FIG. 8 is a diagram illustrating a method of displaying (or enabling perception of) the 3D image using the display panel and the light controlling element illustrated in FIG. 1 when the viewer's eyes are at an imaginary geometric viewing plane that is farther from the display panel (and/or from the light controlling element) than the proper plane, i.e., when the actual viewing distance between the viewer and the display panel is greater than the proper distance between the viewer and the display panel, wherein the proper distance d discussed with reference to FIG. 8
Figure 9:
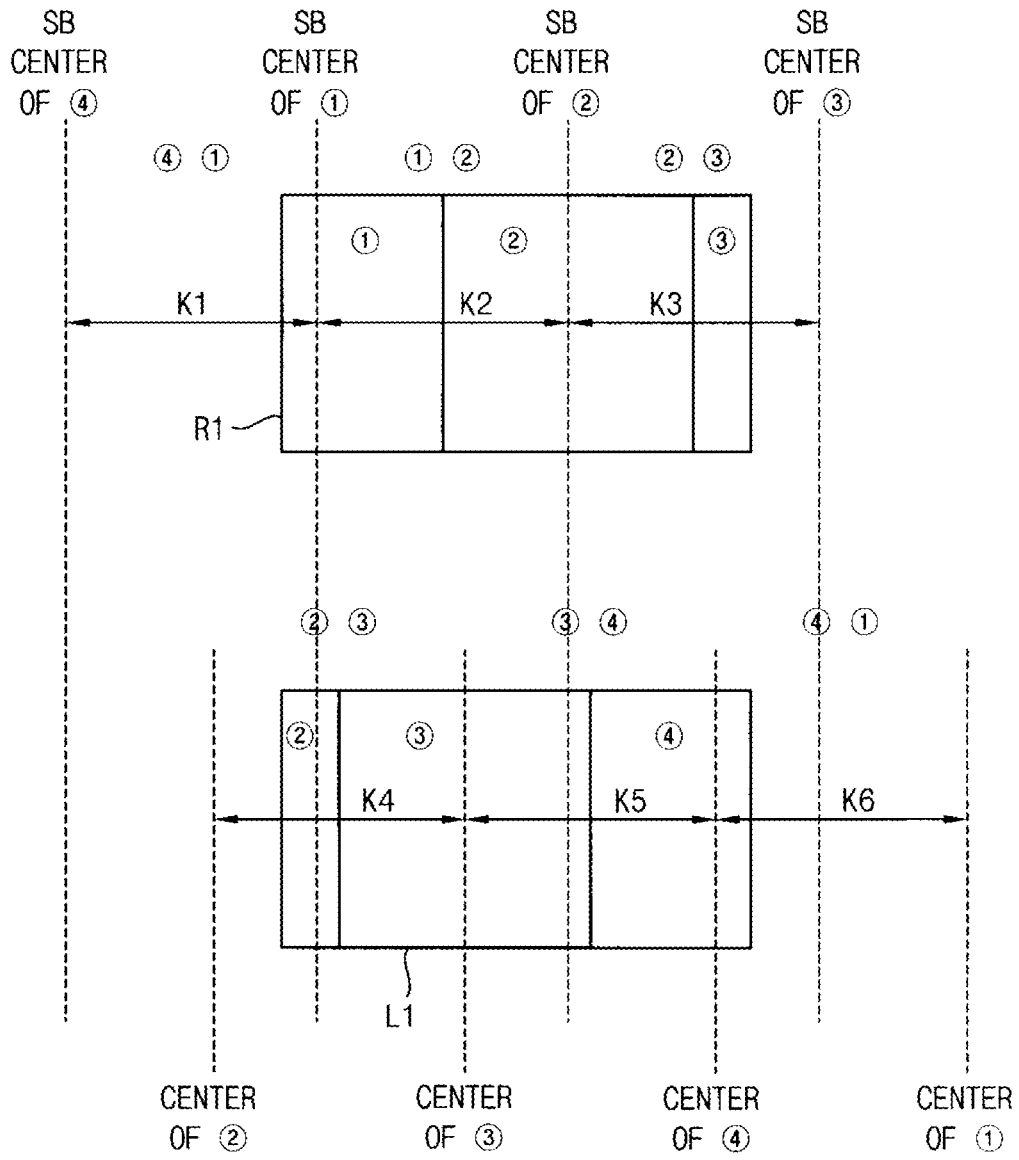
FIG. 9 is the distance (in a direction perpendicular to the display panel) between a viewpoint and the display panel.

FIG. 8 is a diagram illustrating a method of enabling perception of a 3D image using the display panel 100 and the light controlling element 200 illustrated in FIG. 1 when the viewer's eyes are at an imaginary geometric viewing plane that is farther from the display panel (and/or from the light controlling element) than the proper plane, i.e., when a viewer is positioned at a distance greater than the proper distance d. For a convenience of explanation, the proper distance d discussed with reference to FIGS. 8 to 11 may be the distance (in a direction perpendicular to the display panel 100) between a viewpoint and the display panel 100 because the distance between the viewpoint and the light converting element 200 in FIGS. 2A and 2B is much greater than the distance between the light converting element 200 and the display panel 100 FIG. 9 is a diagram illustrating a subpixel rendering method of the display panel 100 illustrated in FIG. 1 when the actual viewing distance between the viewer's a eyes and the display panel 100 is greater than the proper distance d. For conciseness of the description, the phrase "at the proper distance d" may mean "at the proper distance d from the display panel 100" or "at the proper plane"; the phrase "at a (viewing or actual) distance" may mean "at a (viewing or actual) distance from the display panel 100" or "at a viewing plane".

Referring to FIGS. 2A, 2B, 8, and 9, when (the set of eyes of) the viewer is at a distance greater than the proper distance d, a right viewed image RI and a left viewed image LI shown to (or viewed by) the viewer are different from images viewed at the proper distance d.

At the proper distance d, a portion of an image corresponding to the first viewpoint and a portion of an image corresponding to the second viewpoint are shown to the right eye RE of the viewer. Nevertheless, when the viewer is located at a viewing distance h (with respect to the display panel 100 or with respect to the light controlling element 200) greater than the proper distance d, a portion of an image corresponding to the first viewpoint at the proper distance d or the proper plane, an entire image corresponding to the second viewpoint at the proper distance d or the proper plane, and a portion of an image corresponding to the third viewpoint at the proper distance d or the proper plane may be shown to the right eye RE of the viewer. Thus, if the subpixel rendering method at the proper distance d is not adjusted according to the distance of the viewer, the right eye RE of the viewer may view the left image corresponding to the third viewpoint at the viewing distance h so that a crosstalk may occur.

When the viewing distance h of the viewer is greater than the proper distance d, one of positions of the right eye RE (or the right pupil) and the left eye LE (or the left pupil) of the viewer may be set as a base position. Based on the base position, the viewed images RI and LI are divided into a plurality of viewpoint areas.

If each of the widths of the viewed images RI and LI is a, if the viewing distance of the viewer is h, if the proper distance is d, if a width of a display area of the display panel 100 is w, if a distance between corresponding sides of the right viewed image RI and the left viewed image LI is j, if a width of the viewing area is k, and if a distance between the two eyes (or the two pupils) of the viewer is E, the display apparatus may satisfy following Equations 6 to 11.

$$a:\ (h-d) = w:\ h \qquad \text{[Equation 6]}$$

$$a = \frac{(h-d)w}{h} \qquad \text{[Equation 7]}$$

$$d:\ j = h:\ E \qquad \text{[Equation 8]}$$

$$j = \frac{dE}{h} \qquad \text{[Equation 9]}$$

$$h:\ k = (h-d):\ \frac{E}{2} \qquad \text{[Equation 10]}$$

$$k = \frac{hE}{2(h-d)} \qquad \text{[Equation 11]}$$

In FIG. 9, the position of the right eye RE is set to be the base position. Based on the position of the right eye RE, the viewed images RI and LI may be divided into a plurality of viewpoint areas (1), (2), and (3) according to the viewpoints. For example, the viewed right image RI may include viewpoint areas (1), (2), and (3). The viewpoint area boundary between the viewpoint areas (1) and (2) is according to (and consistent with) the viewpoint boundary between viewpoints (1) and (2). The viewpoint area boundary between the viewpoint areas (2) and (3) is according to (and consistent with) the viewpoint boundary between viewpoints (2) and (3).

When the base position is the position of the right eye RE, two subpixels corresponding to two viewpoints defining the closest viewpoint area boundary display right images at a specific area in the viewed image RI. Two other subpixels corresponding to two viewpoints not defining the closest viewpoint area boundary display left images at the specific area. Each specific area is an area between two switching boundaries and defined by the two switching boundaries, which may be two center lines of two viewpoints.

For example, when the specific area is K1 area (illustrated in FIG. 9 and defined by the center line of the fourth viewpoint and the center line of the first viewpoint) closest to a viewpoint area boundary or viewpoint boundary (illustrated in FIG. 8) between the fourth viewpoint and the first viewpoint, subpixels corresponding to the fourth viewpoint and the first viewpoint display right image components, and subpixels corresponding to the second viewpoint and the third viewpoint display left image components.

For example, when the specific area is K2 area (illustrated in FIG. 9) closest to a viewpoint area boundary or viewpoint boundary (illustrated in FIG. 8 and FIG. 9) between the first viewpoint and the second viewpoint, subpixels corresponding to the first viewpoint and the second viewpoint display right image components, and subpixels corresponding to the third viewpoint and the fourth viewpoint display left image components.

For example, when the specific area is K3 area closest to a viewpoint area boundary or viewpoint boundary between the second viewpoint and the third viewpoint, subpixels corresponding to the second viewpoint and the third viewpoint display right images, and subpixels corresponding to the fourth viewpoint and the first viewpoint display left images.

Since the position of the right eye RE of the viewer is set to the base position, an optimal image may not be shown to the left eye LE of the viewer. Thus, the viewer may recognize a two-dimensional ("2D") image at a little area of the display panel 100.

Although the viewed images RI and LI may be divided into a plurality of viewpoint areas according to the viewpoints (1), (2), and (3) based on the position of the right to eye RE of the viewer in one or more embodiments, the present invention is not limited thereto. In one or more embodiments, the viewed images RI and LI may be divided into a plurality of viewpoint areas (2), (3), and (4) according to the viewpoints based on the position of the left eye LE of the viewer. For example, the viewed left image LI may include viewpoint areas (2), (3), and (4). The viewpoint area boundary between the viewpoint areas (2) and (3) is according to (and consistent with) the viewpoint boundary between viewpoints (2) and (3). The viewpoint area boundary between the viewpoint areas (3) and (4) is according to (and consistent with) the viewpoint boundary between viewpoints (3) and (4). Changes of left images and right images displayed by subpixels may correspond to boundaries between K4 area. K5 area and K6 area given that the boundaries between areas K4, K5, and K6 are consistent with switching boundaries SB associated with the viewpoints (2), (3), and (4).

Figure 10:
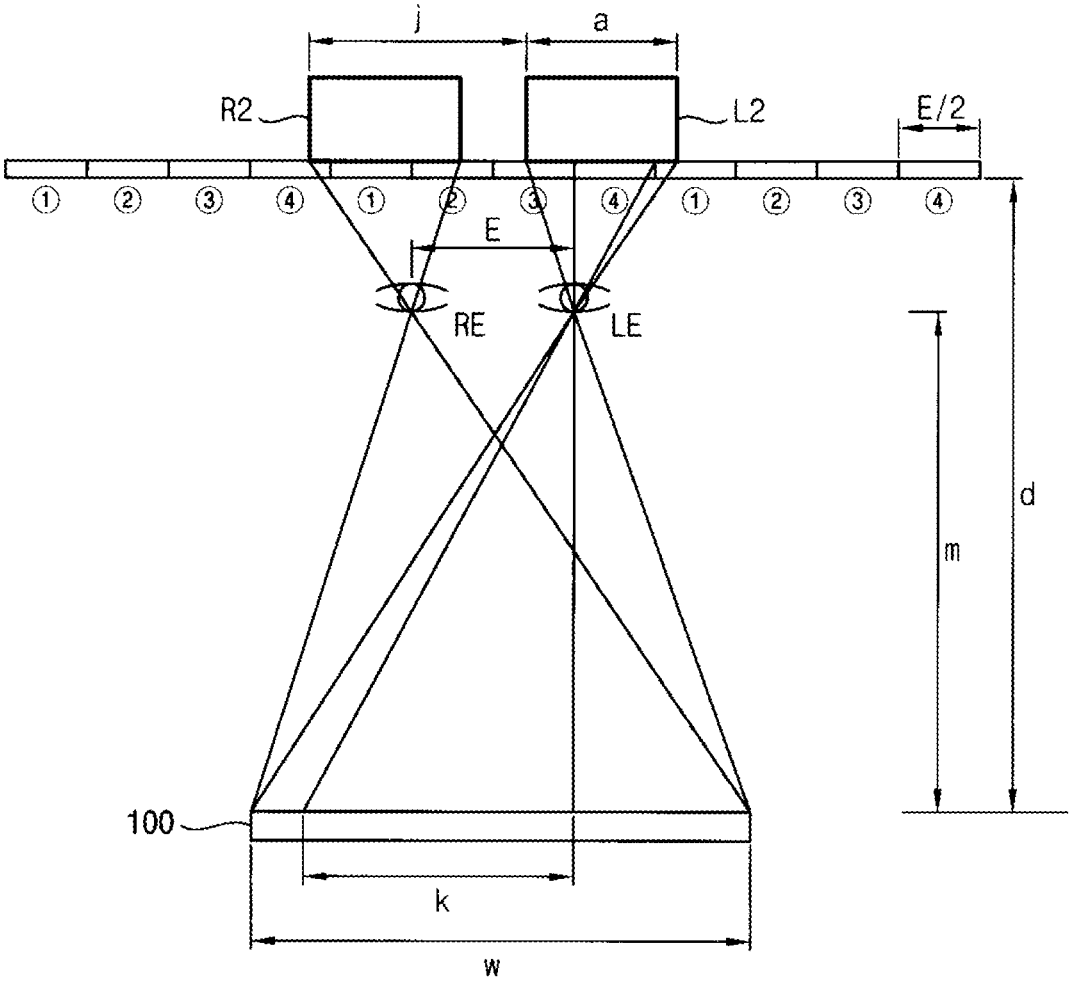
FIG. 10 is a diagram illustrating a method of displaying (or enabling perception of) the 3D image using the display panel and the light controlling element illustrated in FIG. 1 when the actual viewing distance is less than the proper distance, i.e., when the viewer's eyes are at an imaginary geometric viewing plane that is closer to the display panel (and/or to the light controlling element) than the proper plane.
Figure 11:
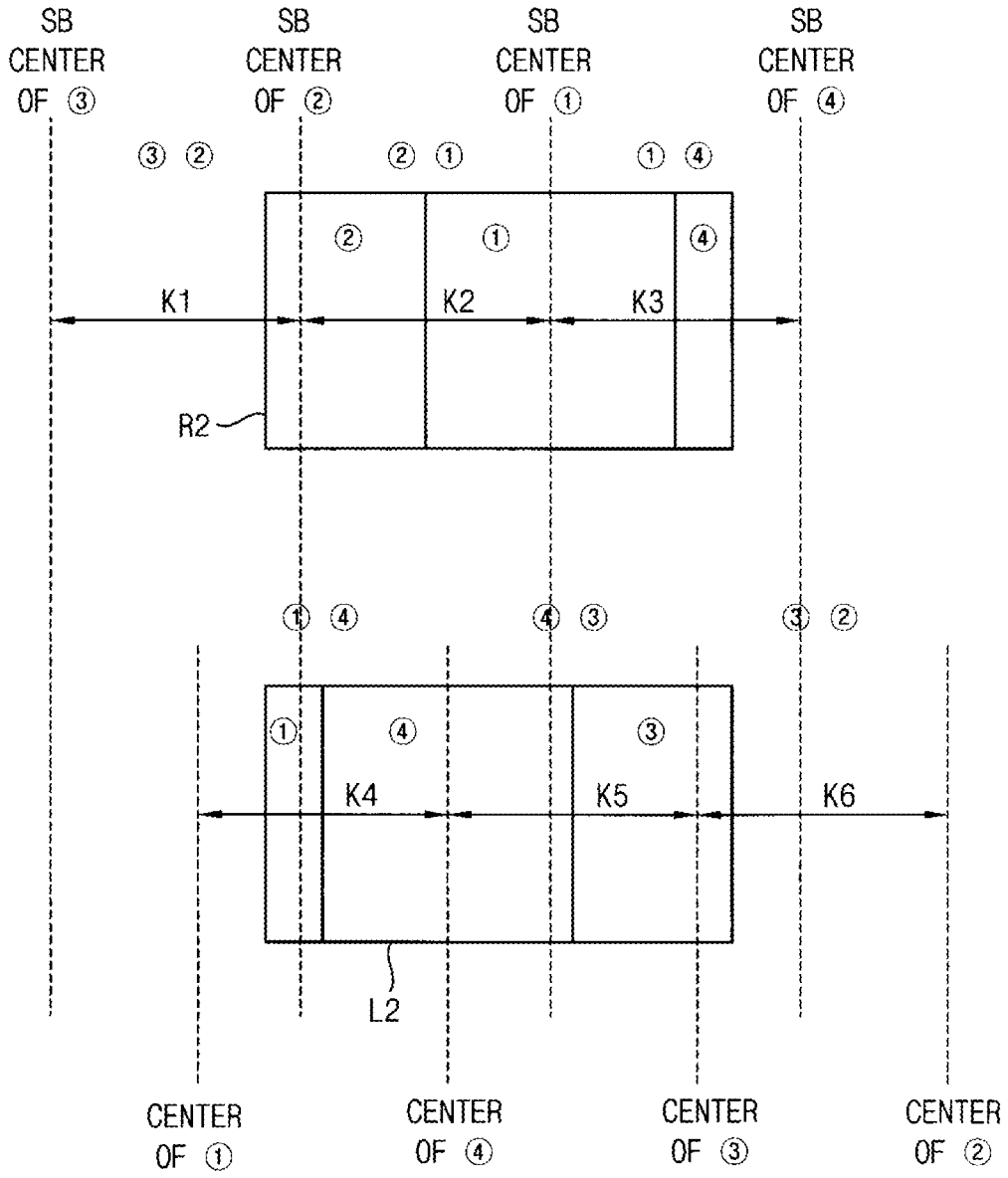
FIG. 11 is a diagram illustrating a subpixel rendering method of the display panel illustrated in FIG. 1 when the actual viewing distance is less than the proper distance.

FIG. 10 is a diagram illustrating a method of displaying (or enabling perception of) the 3D image using the display panel 100 and the light controlling element 200 of FIG. 1 when the viewer's eyes are at an imaginary geometric viewing plane that is closer to the display panel (and/or from the light controlling element) than the proper plane, i.e., when a viewer is positioned at a distance less than the proper distance d. FIG. 11 is a diagram illustrating a subpixel rendering method of the display panel 100 of FIG. 1 when the actual viewing distance between the viewer's eyes and the display panel 100 is less than the proper distance d. For conciseness of the description, the phrase "at the proper distance d" may mean "at the proper distance d from the display panel 100" or "at the proper plane"; the phrase "at a (viewing or actual) distance" may mean "at a (viewing or actual) distance from the display panel 100" or "at a viewing plane".

A method of displaying (or enabling perception of) the 3D image and a subpixel rendering method discussed with reference to FIGS. 10 and 11 when the viewer is positioned at a distance less than the proper distance d may be substantially as analogous to the method of displaying (or enabling perception of) the 3D image and the subpixel rendering method discussed with reference to FIGS. 8 and 9 when the viewer is disposed at a distance greater than the proper distance d.

Referring to FIGS. 2A, 2B, 10, and 11, when the (the set of eyes of) viewer is disposed at a distance less than the proper distance d, a right viewed image R2 and a left viewed image L2 shown to the viewer are different from images viewed at the proper distance d.

At the proper distance d, a portion of an image corresponding to the first viewpoint and a portion of an image corresponding to the second viewpoint are shown to the right eye RE of the viewer. Nevertheless, when the viewer is disposed at a viewing distance m (with respect to the display panel 100 or with respect to the light controlling element 200A) less than the proper distance d, a portion of an image corresponding to the second viewpoint at the proper distance d or the proper plane, an entire image corresponding to the first viewpoint at the proper distance d or the proper plane, and a portion of an image corresponding to the fourth viewpoint at the proper distance d or the proper plane may be shown to the right eye RE of the viewer. Thus, if the subpixel rendering method at the proper distance d is not adjusted according to the distance of the viewer, the right eye RE of the viewer may view the left image corresponding to the fourth viewpoint at the viewing distance m so that a crosstalk may occur.

When the viewing distance m of the viewer is less than the proper distance d, one of positions of the right eye RE (or the right pupil) and the left eye LE (or the left pupil) of the viewer may be set as a base position. Based on the base position, the viewed images R2 and L2 are divided into a plurality of viewpoint areas.

If each of the widths of the viewed images R2 and L2 is a, if the viewing distance of the viewer is m, the proper distance is d, if a width of a display area of the display panel 100 is w, if a distance between corresponding sides of the right viewed image R2 and the left viewed image L2 is j, if a width of the viewing area is k, and if a distance between the two eyes (or the two pupils) of the viewer is E, the display apparatus may satisfy following Equations 12 to 17.

$$a:\ (d-m) = w:\ m \qquad \text{[Equation 12]}$$

$$a = \frac{(d-m)w}{m} \qquad \text{[Equation 13]}$$

$$d:\ j = m:\ E \qquad \text{[Equation 14]}$$

$$j = \frac{dE}{m} \qquad \text{[Equation 15]}$$

$$m:\ k = (d-m):\ \frac{E}{2} \qquad \text{[Equation 16]}$$

$$k = \frac{mE}{2(d-m)} \qquad \text{[Equation 17]}$$

In FIG. 11, the position of the right eye RE is set to be the base position. Based on the position of the right eye RE, the viewed images R2 and L2 may be divided into a plurality of viewpoint areas (2), (1), and (4) according to the viewpoints. For example, the viewed right image R2 may include viewpoint areas (2), (1), and (4). The viewpoint area boundary between the viewpoint areas (2) and (1) is according to (and consistent with) the viewpoint boundary between viewpoints (2) and (1). The viewpoint area boundary between the viewpoint areas (1) and (4) is according to (and consistent with) the viewpoint boundary between viewpoints (1) and (4).

When the base position is the position of the right eye RE, two subpixels corresponding to two viewpoints defining the closest viewpoint area boundary display right images at a specific area in the viewed image R2. Two other subpixels corresponding to two viewpoints not defining the closest viewpoint area boundary display left images at the specific area. Each specific area is an area between two switching boundaries and defined by the two switching boundaries, which may be two center lines of two viewpoints.

Since the position of the right eye RE of the viewer is set to the base position, an optimal image may not be shown to the left eye LE of the viewer. Thus, the viewer may recognize a 2D image at a little area of the display panel 100.

Although the viewed images R2 and L2 may be divided into a plurality of viewpoint areas according to the viewpoints (2), (1), and (4) based on the position of the right eye RE of the viewer in one or more embodiments, the present invention is not limited thereto. In one or more embodiments, the viewed images R2 and L2 may be divided into a plurality of viewpoint areas (1), (4), and (3) according to the viewpoints based on the position of the left eye LE of the viewer. For example, the viewed left image L2 may include viewpoint areas (1), (4), and (3). The viewpoint area boundary between the viewpoint areas (1) and (4) is according to (and consistent with) the viewpoint boundary between viewpoints (1) and (4). The viewpoint area boundary between the viewpoint areas (4) and (3) is according to (and consistent with) the viewpoint boundary between viewpoints (4) and (3). Changes of left images and right images displayed by subpixels may correspond to boundaries between K4 area, K5 area and K6 area given that the boundaries between areas K4, K5, and K6 are consistent with switching boundaries SB associated with the viewpoints (1), (4) and (3).

According to one or more embodiments, when the viewer moves in forward and backward directions with respect to the display panel 100) (i.e., when the view moves toward the display panel 100 or moves away from the display panel 100), the display panel driver 300 may operate the proper subpixel rendering method so that the display panel 100 may display (or enable perception of) the 3D image.

Figure 12A:
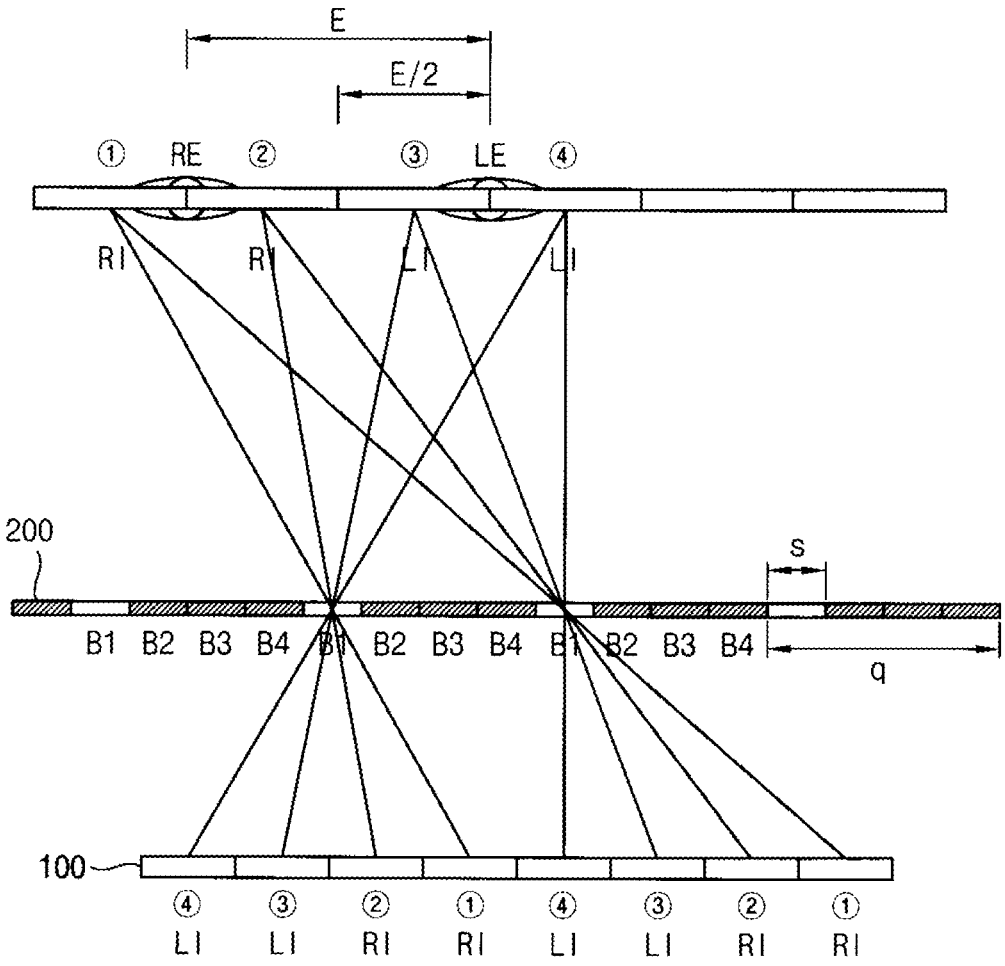
FIGS. 12A and 12B are diagrams illustrating a method of shifting a transmitting portion of the light controlling element illustrated in FIG. 1 for a new (or subsequent) frame and/or in each frame.
Figure 12B:
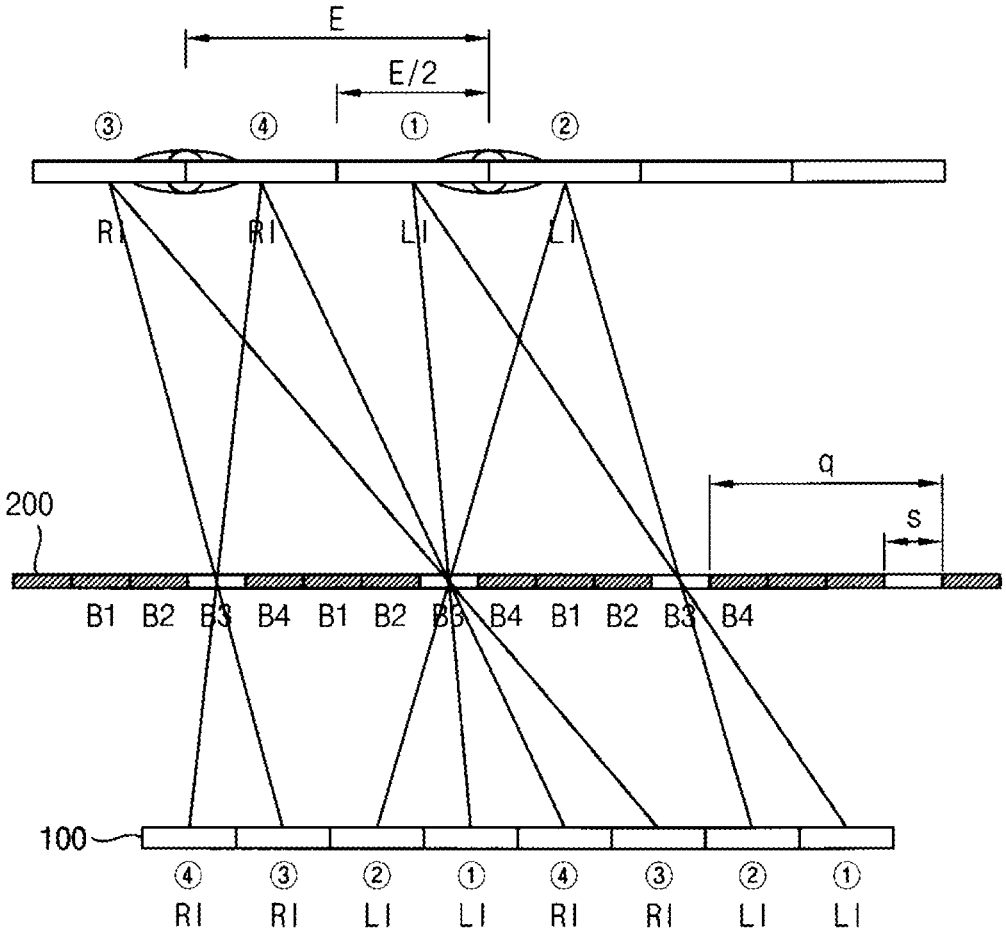

FIGS. 12A and 12B are diagrams illustrating a method of shifting a transmitting portion of the light controlling element 200 (also illustrated in FIG. 1) for a new (or subsequent) frame and/or in each frame.

FIG. 12A illustrates the display apparatus in the first frame. FIG. 12B illustrates the display apparatus in the second frame.

In one or more embodiments, at least one transmitting portion (and/or each transmitting portion) of the light controlling element 200 may be shifted for each new (or subsequent) frame and/or in each frame. The image components displayed by subpixels of the display panel 100 may switch from right image components to left image components and may switch from left image components to right image components for each new (or subsequent) frame and/or in each frame.

Referring to FIG. 12A, the light controlling element 200 includes first to fourth portions B1 to B4 (in each four-portion set). In a first frame, a right image RI displayed on subpixels (e.g., the first subpixels and the second subpixels of four-subpixel sets) corresponding to the first and second viewpoints of a first four-viewpoint set is shown to a right eye RE of the viewer through first portions B1 of four-portion sets of the light controlling element 200). A left image LI displayed on subpixels (e.g., the third subpixels and the fourth subpixels of four-subpixel sets) corresponding to the third and fourth viewpoints of the first four-viewpoint sets is shown to a left eye LE of the viewer through first portions B1 of four-portion sets of the light controlling element 200. In the first frame, transmitting portion TA of the light controlling element 200 may be at the first portions B1 of the four-portion sets of the light controlling element 200.

Referring to FIG. 12B, in a second frame, the right image RI displayed on subpixels (e.g., the third subpixels and the fourth subpixels of four-subpixel sets) corresponding to the third and fourth viewpoints of a second four-viewpoint set immediately neighboring the first four-viewpoint set is shown to the right eye RE of the viewer through third portions B3. The left image LI displayed on subpixels corresponding to the first and second viewpoints of the first four-viewpoint set is shown to the left eye LE of the viewer through third portions B3. In the second frame, transmitting portion TA of the light controlling element 200 may be at the third portions B3 of the four-portion sets of the light controlling element 200.

As can be appreciated from the discussion with reference to FIG. 12A and FIG. 12B, the transmitting portions of the light controlling element 200 may shift by a half of a pitch q of the unit of the light controlling element 200, e.g., from first portions B1 to third portions B3, for each new (or subsequent) frame and/or in each frame. The pitch q is substantially equal to four times the width s of each portion and/or substantially equal to four times the width s of a transmitting portion.

According to one or more embodiments, the display panel driver 300 properly changes the images displayed by the display panel 100 according to the position of the viewer so that the 3D-image display apparatus may effectively display (or enable perception of) 3D images even if the viewer moves with respect to the display apparatus. The change of the displayed images for accommodating the viewer movement may not be substantially conspicuous to the viewer. Crosstalk also may be minimized or prevented so that the display quality of the 3D images may be satisfactory.

Figure 13A:
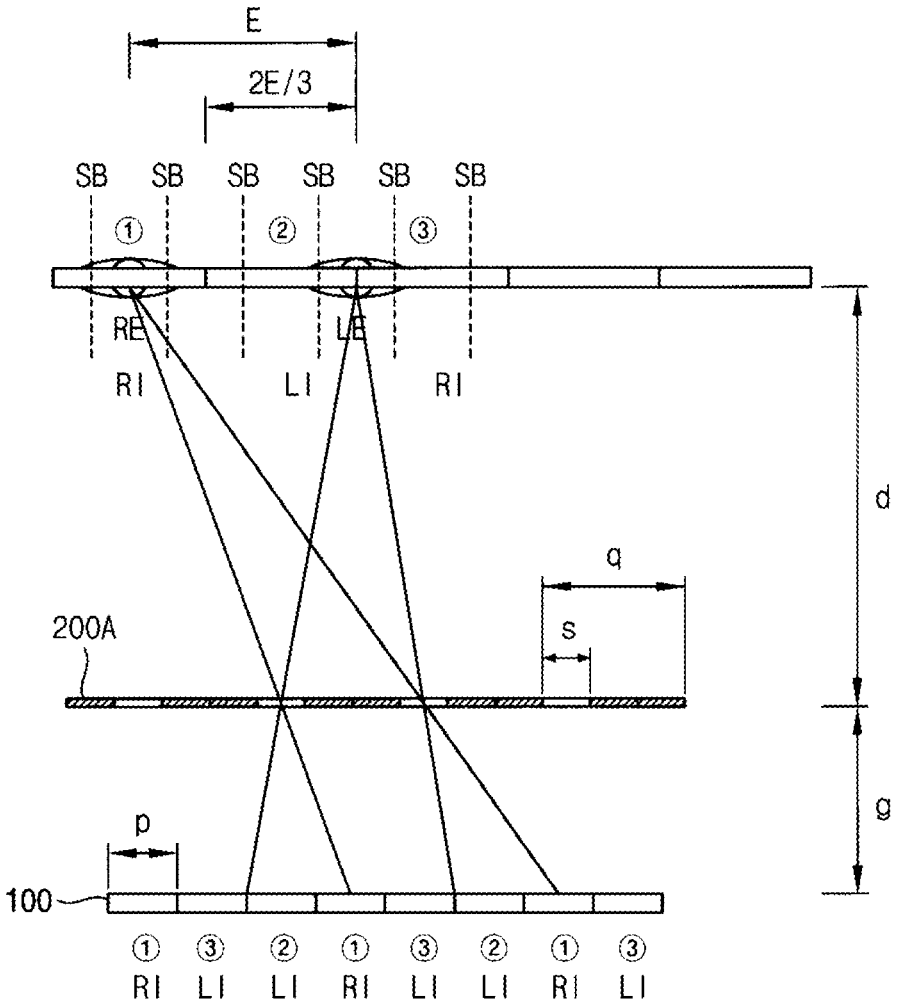
FIG. 13A is a diagram illustrating a method of displaying (or enabling perception of) a 3D image using a display panel and a light controlling element according to one or more embodiments when a viewer is at the proper distance from the light controlling element, i.e., when the viewer's eyes are at the proper plane.
Figure 13B:
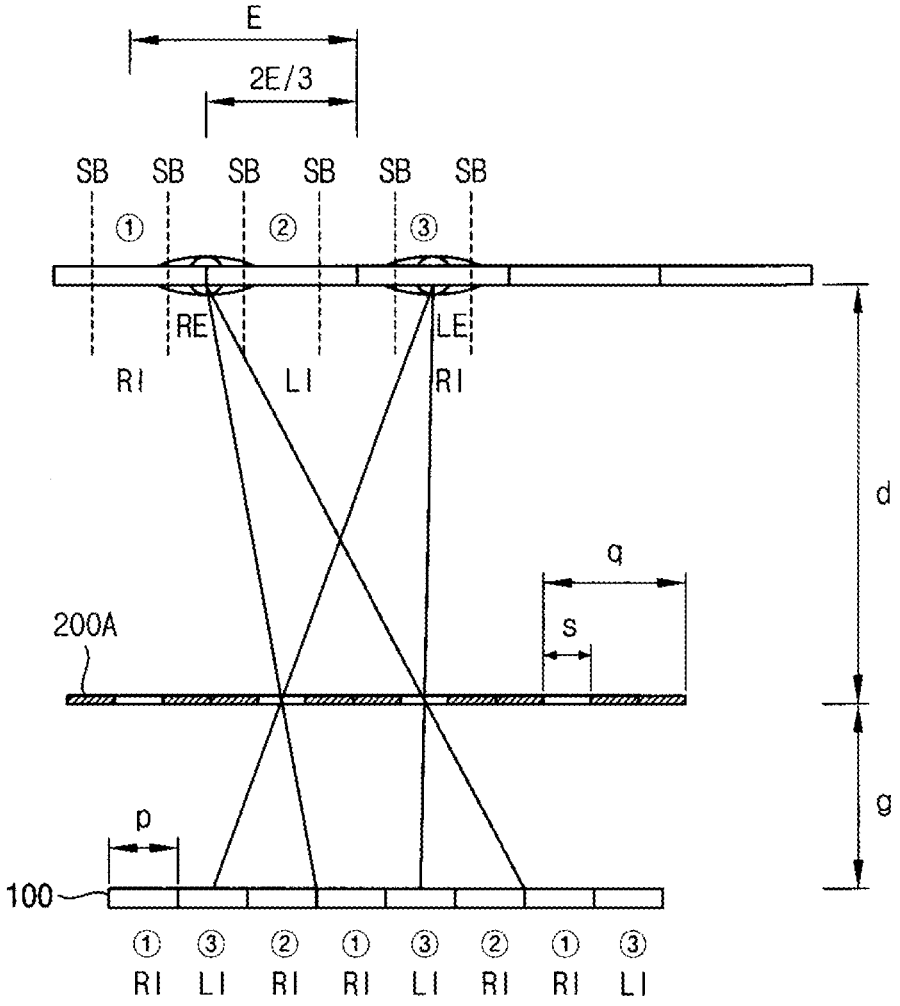
FIG. 13B is a diagram illustrating a method of displaying (or enabling perception of) the 3D image using the display panel and the light controlling element of FIG. 13A when the viewer moves while remaining at the proper distance from the light controlling element, i.e., when the viewer moves with the viewer's eyes remaining at the proper plane.
Figure 14:
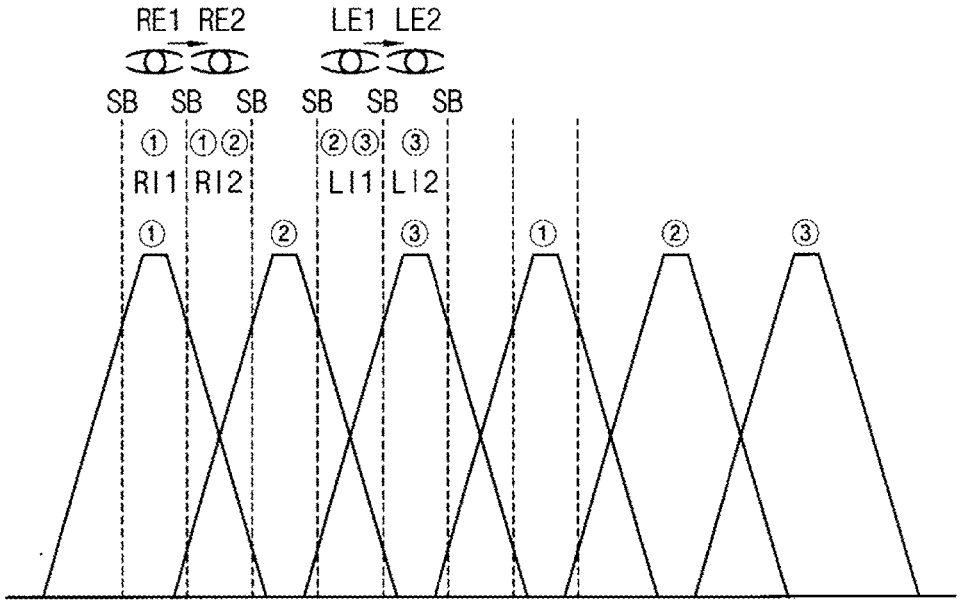
FIG. 14 is a graph illustrating luminances of viewpoint images corresponding to subpixels of the display panel of FIG. 13A when the viewer moves while remaining at the proper distance from the light controlling element.

FIG. 13A is a diagram illustrating a method of displaying (or enabling perception of a 3D image using a display panel 100 and a light controlling element 200A according to one or more embodiments when a viewer is at the proper distance d from the light controlling element and/or the display panel, i.e., when the viewer's eyes are at the proper plane. FIG. 13B is a diagram illustrating a method of displaying (or enabling perception of) the 3D image using the display panel 100 and the light controlling element 200A of FIG. 13A when the viewer moves in a direction parallel to the display panel 100 while remaining at the proper distance d from the light controlling element and/or the display panel, i.e., when the viewer moves with the viewer's eyes remaining at the proper plane. FIG. 14 is a graph illustrating luminances of viewpoint images corresponding to subpixels of the display panel 100 of FIG. 13A when the viewer moves while remaining at the proper distance d from the light controlling element and/or the display panel.

The display apparatus discussed with reference to FIGS. 13A, 13B, and 14 is analogous to the display apparatus explained with reference to FIGS. 1 to 12B. Nevertheless, the images displayed on the subpixels of the display panel 100 illustrated in FIGS. 13A and 13B are repeated in a cycle of three subpixels, the viewpoints at the proper plane are grouped (and repeated) in sets of three, and the units of the light controlling element 200A are grouped (and repeated) in sets of three. The same reference numerals may be used to refer to the same or like parts as those described with reference to FIGS. 1 to 12B, and repetitive explanation may be omitted.

Referring to FIGS. 1, 13A, 13B, and 14, the display apparatus includes a display panel 100, a light controlling element 200A, a display panel driver 300, and a position detecting part 400.

The light controlling element 200A is disposed on (or overlaps) the display panel 100. In one or more embodiments, the light controlling element 200A may include a barrier module, as shown in FIGS. 13A and 13B. In one or more embodiments, the light controlling element 200A in may include a lenticular lens module.

The display panel 100 includes a plurality of the subpixels. Images displayed on the subpixels of the display panel 100 may be repeated in three-subpixel sets each including three subpixels. As illustrated in FIG. 13A, among the three subpixels in a three-subpixel set, one subpixel may displays a right image component RI for the right eye RE of the viewer, and two adjacent subpixels may display left image components LI for the left eye LE of the viewer. As illustrated in FIG. 13B, among the three subpixels in a three-subpixel set, two adjacent subpixels may display right image components RI for the right eye RE of the viewer, and one subpixel may display a left image component LI for the left eye LE of the viewer.

The light controlling element 200A may include at least one transmitting portion and at least one blocking portion. An image component displayed by one subpixel may be transmitted to at least one viewpoint through the light controlling element 200A. In one or more embodiments, the light controlling element 200A may be associated with three viewpoints.

In one or more embodiments, the light controlling element 200A may not move with respective to the display panel 100, i.e., the light controlling element 200 may remain stationary with respect to the display panel 100. In one or more embodiments, the light controlling element 200A may move in a (horizontal) direction parallel to the display panel 100. In one or more embodiments, the transmitting portion of the light controlling element 200A may shift in the direction parallel to the display panel 100. A method of shifting the transmitting portion of the light controlling element 200A in each frame is further discussed with reference to FIGS. 18A and 18B.

An image displayed by a first subpixel <1> of a first three-subpixel set may be transmitted to a first viewpoint (1) (i.e., circle 1 shown in figures) through the light controlling element 200A. An image displayed by a second subpixel <2> of the first three-subpixel set immediately adjacent to the first subpixel may be transmitted to a second viewpoint $\hat{2}$ (i.e., circle 2 shown in figures) through the light controlling element 200A. An image displayed by a third subpixel <3> of the first three-subpixel set immediately adjacent to the second subpixel may be transmitted to a third viewpoint (3) (i.e., circle 3 shown in figures) through the light controlling element 200A. An image displayed by a fourth subpixel (i.e., a first subpixel of a second three-subpixel set) immediately adjacent to (the left side of) the third subpixel is transmitted to the first viewpoint (1) through the light controlling element 200A. An image displayed by a fifth subpixel (i.e., a second subpixel of the second three-subpixel set) immediately adjacent to the fourth subpixel is transmitted to the second viewpoint $\hat{2}$ through the light controlling element 200A. An image displayed by a sixth subpixel (i.e., a second subpixel of the second three-subpixel set) immediately adjacent to the fifth subpixel may be transmitted to the third viewpoint (3) through the light controlling element 200A. As illustrated in FIG. 13A, the fourth subpixel, the fifth subpixel, and the sixth subpixel may represent the first subpixel, the second subpixel, and the third subpixel, and the fourth subpixel of the second three-subpixel set. The numbering of the viewpoints of a three-viewpoint set may be in a reverse order with respect to the numbering of the subpixels of each corresponding three-subpixel set. In the figures, the RIs and LIs associated with different three-subpixel sets (and/or different subpixels) may respectively represent different components of right-eye images and different components of left-eye images displayed by different three-subpixel sets (and/or different subpixels); the RIs and LIs associated with the eyes of the viewer may respectively represent the combined right-eye image and the combined left-eye image received by the viewer's right eye and left eye, respectively.

In one or more embodiments, a proper distance d for the 3D image is defined as a distance between the viewer (or the viewer's eyes) and the light controlling element 200 or between the viewer (or the viewer's eyes) and the display panel 100 at which a width of a viewpoint image (i.e., the range of the light associated with an image component displayed by a subpixel, transmitted through the light controlling element 200A, and received at a viewpoint at the proper plane; or the range of the light associated with same-eye image components displayed by two immediately neighboring subpixels, transmitted through the light controlling element 200A, and received at a viewpoint at the proper plane) is substantially equal to ⅔ of a distance E between (the pupils of) two eyes of the viewer. If the viewer's eyes are at the proper plane, the width of a viewpoint (or viewpoint image) is (⅔)E, and a one eye is at the center of a viewpoint when the other eye is at the boundary between two other viewpoints.

In one or more embodiments, three proper distance (or proper plane) viewpoint areas (1), (2), and (3) (i.e., circle 1, circle 2, and circle 3 shown in FIG. 13A) are associated with two eyes of the viewer. In FIG. 13A, a portion of a first proper distance viewpoint area (1), an entire second proper distance viewpoint area (2), and a portion of a third proper distance viewpoint area (3) are disposed between the outer edges of the two eyes of the viewer. A switching boundary SB of a viewpoint is located at a central position between a center of a proper distance (or proper plane) viewpoint area and a boundary of the proper distance viewpoint area. As illustrated in FIG. 13A, if the viewer's eyes are at the proper distance d (or at the proper plane), when the right eye RE of the viewer is close to the center of the proper distance viewpoint area, in a three-subpixel set, a subpixel (e.g., the first subpixel) may correspond to the proper distance viewpoint area overlapping the right eye RE and may display a right image component RI. In the three-subpixel set, the other two (immediately neighboring) subpixels (e.g. the second subpixel and the third subpixel) may correspond to another proper distance viewpoint area and may display left image components LI.

As illustrated in FIG. 13B, if the viewer's eyes are at the proper distance d (or at the proper plane), when the right eye RE of the viewer is close to the boundary between two of the proper distance viewpoint areas (e.g., the first proper distance view point area and the second proper distance area), in a three-subpixel set, two (immediately neighboring) subpixels (e.g., the first subpixel and the second subpixel) may correspond to the two proper distance viewpoint areas (e.g., the first proper distance view point area and the second proper distance area) and may display right image components RI. In the three-subpixel set, the remaining subpixel (e.g., the third subpixel) may correspond to the remaining proper distance viewpoint area (e.g., the third proper distance viewpoint area) and may display a left image component LI.

If the viewer's eyes are at the proper distance d (or at the proper plane), i.e., when the distance between the viewer and the light controlling element 200A is d the display panel driver 300 may switch the right image components RI and the left image components LI displayed by at least some of the subpixels when the viewer has moved in the direction D1 (indicated in FIG. 1) by E/3, i.e., ⅓ of the distance E, wherein E may be the distance between (the pupils of) the two eyes of the viewer. Advantageously, the viewer may perceive substantially consistent (3D) images and satisfactory display quality.

In one or more embodiments, if a width of a subpixel (or of each subpixel) in the first direction D1 is p, if a distance between the display panel 100 and the light controlling element 200A is g, if the distance between (the pupils of) the two eyes of the viewer is E, if the proper distance between the proper plane and the light controlling element 200A is d, if a width of the transmitting portion in the first direction D1 is s, and if a pitch of a unit barrier is q, then the display apparatus may satisfy following Equations 18 to 24.

$$p: g = \frac{2E}{3}: d \quad \text{[Equation 18]}$$

$$d = \frac{2Eg}{3p} \quad \text{[Equation 19]}$$

$$d: s = (d+g): p \quad \text{[Equation 20]}$$

$$s = \frac{dp}{(d+g)} \quad \text{[Equation 21]}$$

$$s = \frac{2Ep}{(2E+3p)} \quad \text{[Equation 22]}$$

$$q = 3s \quad \text{[Equation 23]}$$

$$q = \frac{6Ep}{(2E+3p)} \quad \text{[Equation 24]}$$

In FIG. 13A, image components displayed on the subpixels (e.g., the two first subpixels of two three-subpixel sets) corresponding to the first viewpoint of a three-viewpoint set are shown to the right eye RE of the viewer through two of the transmitting portions of the light controlling element 200A. Analogously, image components displayed by other subpixels corresponding to the first viewpoint of the three-viewpoint set may also be shown to the right eye RE of the viewer through other transmitting portions of the light controlling element 200A. The subpixels corresponding to the first viewpoint display the right image RI.

Image components displayed on the subpixels (e.g., the two second subpixels and the two third subpixels of the two three-subpixel sets) corresponding to the second viewpoint and the third viewpoint of the three-viewpoint set are shown to the left eye LE of the viewer through the two of the transmitting portions of the light controlling element 200A. Analogously, image components displayed by other subpixels corresponding to the second viewpoint and the third viewpoint of the three-viewpoint set may also be shown to the left eye LE of the viewer through other transmitting portions of the light controlling element 200A. The subpixels corresponding to the second viewpoint and the third viewpoint display the left image LI.

With reference to the positions of the eyes illustrated in FIG. 13A, FIG. 13B illustrates that the right eye RE and the left eye LE of the viewer have moved by E/3, i.e., ⅓ of the distance E between (the pupils of) the two eyes of the viewer, in the first direction D1. Before the movement, as illustrated in FIG. 13A, the pupil of the right eye RE may be positioned at the center of the first viewpoint the three-viewpoint set, and the pupil of the left eye LE may be positioned at the boundary of the second viewpoint and the third viewpoint of the three-viewpoint set. After the movement, as illustrated in FIG. 13B, the pupil of the right eye RE may be positioned at the boundary of the first viewpoint and the second viewpoint of the three-viewpoint set, and the pupil of the left eye LE may be positioned at the center of the third viewpoint of the three-viewpoint set.

In response to the movement of the viewer's eyes, the two first subpixels and the two second subpixels of the two three-subpixel sets may become corresponding to the first viewpoint and the second viewpoint, and the image components displayed by the subpixels (e.g., the two first subpixels and the two second subpixels of the two three-subpixel sets) corresponding to the first viewpoint and the second viewpoint are shown to the right eye RE of the viewer through the two of the transmitting portions of the light controlling element 200A. Analogously, image components displayed by other subpixels corresponding to the first viewpoint and the second viewpoint of the three-viewpoint set may also be shown to the right eye RE of the viewer through other transmitting portions of the light controlling element 200A. In response to the eye movement, instead of displaying left image components LI (as illustrated in FIG. 13A), the second subpixels of the four-subpixel sets may become displaying right image components RI (as illustrated in FIG. 13B). The subpixels corresponding to the first viewpoint and the second viewpoint display the right image RI.

In response to the movement of the viewer's eyes, the two third subpixels of the two three-subpixel sets may become corresponding to only the third viewpoint, and the image components displayed by the subpixels (e.g., the two third subpixels of the two three-subpixel sets) corresponding to the third viewpoint are shown to the left eye LE of the viewer through the two of the transmitting portions of the light controlling element 200A. Analogously, image components displayed by other subpixels corresponding to the third viewpoint of the three-viewpoint set may also be shown to the left eye LE of the viewer through other transmitting portions of the light controlling element 200A. The subpixels corresponding to the third viewpoint display the left image LI.

When the right eye RE and the left eye LE of the viewer are respectively located at positions RE1 and LE1 in FIG. 13A, the display panel driver 300 drives the display panel 100 to display the right image RI on the subpixels corresponding to the first viewpoint and to display the left image LI on the subpixels corresponding to the second viewpoint and the third viewpoint.

When the right eye RE and the left eye LE of the viewer are respectively located at positions RE2 and LE2 in FIG. 13B, the display panel driver 300 drives the display panel 100 to display the right image RI on the subpixels corresponding to the first and to display second viewpoints and the left image LI on the subpixels corresponding to the third viewpoint.

Therefore, when the right eye RE and the left eye LE of the viewer have moved from the positions RE1 and LE1 in FIG. 13A to the positions RE2 and LE2 in FIG. 13B, the display panel driver 300 replace the left image components LI of subpixels (e.g., the second subpixels of three-subpixel sets) corresponding to the second viewpoint with right image components RI.

In one or more embodiments, when the viewer moves in the horizontal direction (i.e., the first direction D1) with respect to the display panel 10), the display apparatus may enable perception of a 3D image using a subpixel rendering method of the display panel driver 300 without moving the light controlling element 200A.

FIG. 14 illustrates luminances of the viewpoint images, i.e., the images displayed by the subpixels and focused and combined at the respective viewpoints when the distance between the viewer's eyes and the light controlling element 200 is substantially equal to the proper distance d. When the right eye RE of the viewer is located at a first position RE1 in FIG. 13A, the images displayed by the subpixels corresponding to the first viewpoint and the second viewpoint are strongly shown to the right eye RE and are labeled RI1 in FIG. 14.

When the right eye RE of the viewer (gradually) moves from the first position RE1 in FIG. 13A to a second position RE2 in FIG. 13B, as perceived by the right eye RE, a luminance of the image displayed by the subpixels corresponding to the first viewpoint decreases and a luminance of the image displayed by the subpixels corresponding to the second viewpoint increases.

When the left eye LE of the viewer (gradually) moves from a third position LE1 in FIG. 13A to a fourth position LE2 in FIG. 13B, as perceived by the left eye LE, a luminance of the image displayed by the subpixels corresponding to the second viewpoint decreases and a luminance of the image displayed by the subpixels corresponding to the third viewpoint increases.

When the right eye RE of the viewer is located at a switching boundary SB between the first position RE1 and the second position RE2 and when the left eye LE of the viewer is disposed at a switching boundary SB between the third position LE1 and the fourth position LE2, the luminance of the image components displayed by the subpixels corresponding to the second viewpoint is stronger at the right eye RE of the viewer than the light eye LE of the viewer.

Thus, when the right eye RE of the viewer gradually moves from the first position RE1 in FIG. 13A to a second position RE2 in FIG. 13B, the display panel driver 300 may replace the left image components LI displayed by the subpixels corresponding to the second viewpoint with right image components RI at the switching boundary SB between the positions RE1 and RE2.

At the switching boundary SB (a possible position of the right eye RE of the viewer that corresponds to a change of image-eye association) between the first position RE1 and the second position RE2, the luminances of the images corresponding to the second viewpoint have a very low value. Thus, although the image components displayed on the subpixels corresponding to the second viewpoint switch from left image components LI to right image components RI when the right eye RE of the viewer is substantially at the switching boundary SB, the viewer may not substantially recognize change of the display image.

In one or more embodiments, in average, in a three-subpixel set, 1.5 subpixels may display left images LI, and 1.5 subpixels may display right images RI. Advantageously, crosstalk may be prevented. Even if the detection of the position of the viewer by the position detecting part 400 is not precise, crosstalk may be substantially reduced or prevented.

Figure 15:
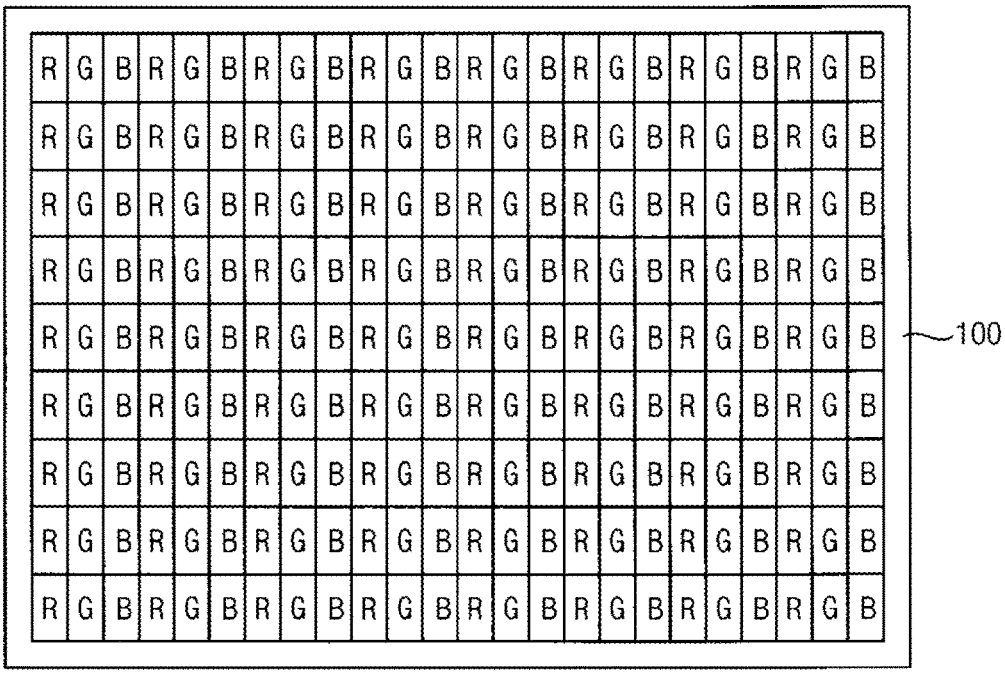
FIG. 15 is a plan view illustrating a pixel structure of the display panel illustrated in FIG. 13A.
Figure 16:
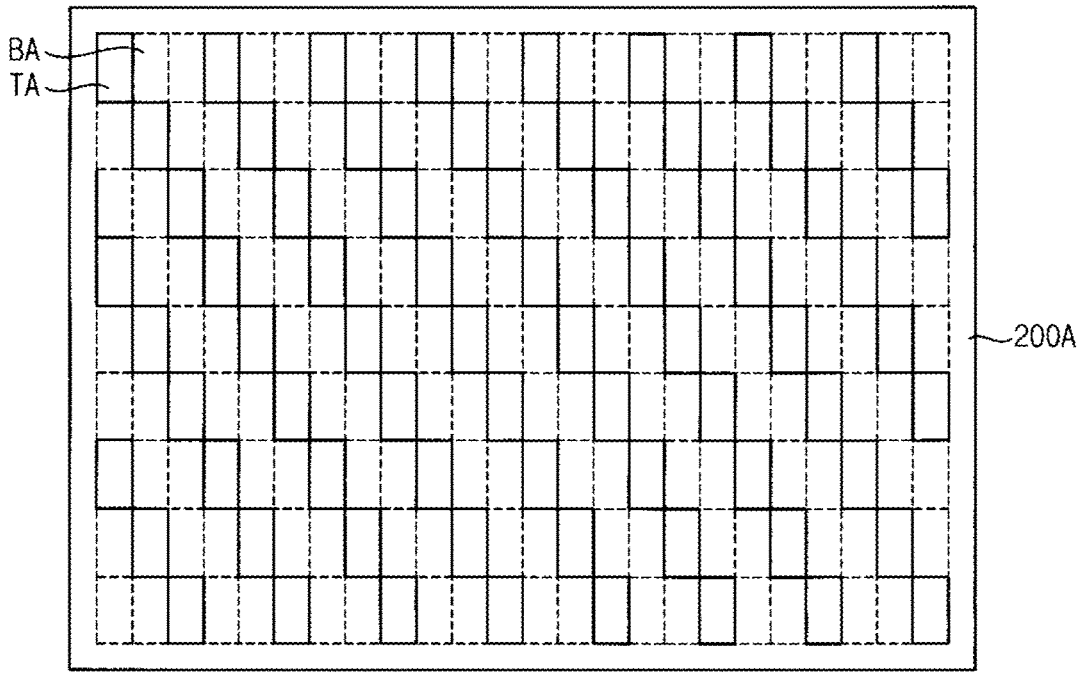
FIG. 16 is a plan view illustrating a configuration of the light controlling element illustrated in FIG. 13A.
Figure 17:
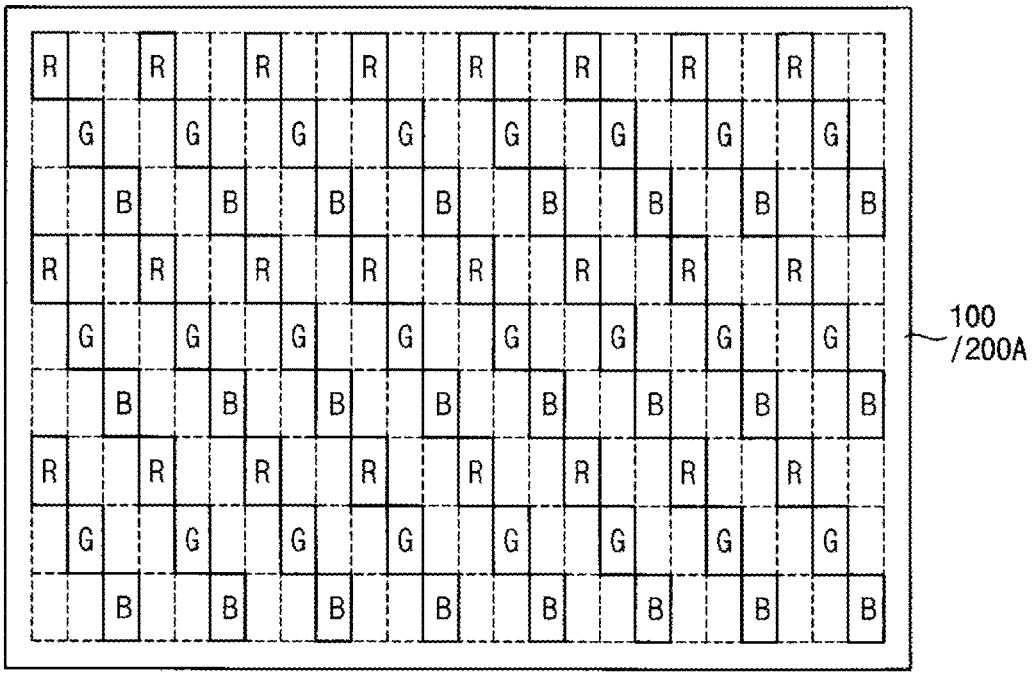
FIG. 17 is a plan view illustrating an image displayed by the display panel illustrated in FIG. 13A and shown to the viewer through the light controlling element illustrated in FIG. 13A at a viewpoint.

FIG. 15 is a plan view illustrating a pixel structure of the display panel 100 illustrated in FIG. 13A. FIG. 16 is a plan view illustrating a configuration of the light controlling element 200A illustrated in FIG. 13A. FIG. 17 is a plan view illustrating an image displayed by the display panel 100 illustrated in FIG. 13A and shown to the viewer through the light controlling element 200A illustrated in FIG. 13A at a viewpoint.

Referring to FIGS. 1, 13A, 15 to 17, the display panel 100 includes a plurality of pixels. The pixels may be disposed in a matrix form.

The pixels include a plurality of subpixels. Each subpixel may have a rectangular shape (or rectangular configuration). Each subpixel may have a shorter side in the first direction D1 and a longer side in the second direction D2.

The pixels (or a pixel) may include a red subpixel R, a green subpixel G and a blue subpixel B.

As illustrated in FIG. 15, the subpixels R, G and B may be alternately (or sequentially and repeatedly) disposed along the first direction D1 (indicated in FIG. 1). The red subpixels R may be disposed in columns that extend in the second direction D2. The green subpixels G may be disposed in columns that extend in the second direction D2. The blue subpixels B may be disposed in columns that extend in the second direction D2.

The light controlling element 200A, as illustrated in FIG. 16, may be a barrier module having transmitting portions TA and blocking portions BA. The transmitting portions TA and the blocking portions BA may have matrix patterns. The barrier module includes a plurality of units. Each unit of the plurality of units may correspond to three subpixels and may include a transmitting portion TA and a blocking portions BA. In one or more embodiments, a ratio between a width of the transmitting portion TA in the first direction D1 and a width of the blocking portion BA in the first direction D1 in the unit barrier is about 1:2.

The transmitting portions TA corresponding to a second pixel row may be shifted by a width of a subpixel or by a width of a transmitting portion TA in the first direction D1 with respect to a position of the transmitting portions TA corresponding to a first pixel row immediately neighboring the second pixel row. For example, a first transmitting portion TA corresponding to the first pixel row may be aligned in the second direction D2 (indicated in FIG. 1) with a first half of a first blocking portion BA corresponding to the second pixel row, wherein a first transmitting portion TA corresponding to the second pixel row may be disposed between the first half of the first blocking portion BA corresponding to the second pixel row and a second half of the first blocking portion BA corresponding to the second pixel row. The first transmitting portion TA corresponding to the second pixel row may be aligned in the second direction D2 with a first half of a first blocking portion BA corresponding to the first pixel row.

At a viewpoint, the subpixels R, G and B of the display panel 100 are shown to the viewer as illustrated in FIG. 17 through the transmitting portions TA of the light controlling element 200A. The subpixels shown to the viewer substantially evenly display the red color, the green color, and the blue color.

In one or more embodiments, a method of displaying (or enabling perception of) the 3D image and a subpixel rendering method when the viewer is positioned at a distance greater than the proper distance d may be substantially as analogous to the method of displaying (or enabling perception of) the 3D image and a subpixel rendering method explained with reference to FIGS. 8 and 9. Thus, repetitive explanation may be omitted.

When the viewing distance h of the viewer (i.e., the distance h between the viewer's pupils and the light controlling element 200A or between the viewer's pupils and the display panel 100) is greater than the proper distance d, one of positions of the right eye RE (or the right pupil) and the left eye LE (or the left pupil) of the viewer may be set as a base position. Based on the base position, the viewed images RI and LI are divided into a plurality of viewpoint areas.

If each of the widths of the viewed images RI and LI is a, if the viewing distance of the viewer is h, if the proper distance is d, if a width of a display area of the display panel 100 is w, if a distance between corresponding sides of the right viewed image RI and the left viewed image LI is j, if a width of the viewing area is k, and if a distance between the two eyes (or the two pupils) of the viewer is E, the display apparatus may satisfy following Equations 25 to 30.

$$a: (h-d) = w: h \quad \text{[Equation 25]}$$

$$a = \frac{(h-d)w}{h} \quad \text{[Equation 26]}$$

$$d: j = h: E \quad \text{[Equation 27]}$$

$$j = \frac{dE}{h} \quad \text{[Equation 28]}$$

$$h: k = (h-d): \frac{E}{3} \quad \text{[Equation 29]}$$

$$k = \frac{hE}{3(h-d)} \quad \text{[Equation 30]}$$

When the base position is the position of the right eye RE, and when a specific area in the viewed image RI is closer to a center of a first viewpoint area than a boundary between the first viewpoint area and a second viewpoint area, a subpixel corresponding to the first viewpoint area displays a right image component RI at the specific area in the viewed images RI and LI. Subpixels corresponding to the second viewpoint area and the third viewpoint area display left images LI at the specific area.

When the base position is the position of the right eye RE, and when a specific area in the viewed image RI is closer to the boundary between the first viewpoint area and a second viewpoint area than the center of a first viewpoint area, subpixels corresponding to the first viewpoint area and the second viewpoint area display right image components RI at the specific area in the viewed images RI and LI. A subpixel corresponding to the third viewpoint area displays a left image component LI at the specific area.

In one or more embodiments, a method of displaying (or enabling perception of) the 3D image and a subpixel rendering method when the viewer is positioned at a distance less than the proper distance d may be substantially as analogous to the method of displaying (or enabling perception of) the 3D image and a subpixel rendering method explained with reference to FIGS. 10 and 11. Thus, repetitive explanation may be omitted.

When the viewing distance m of the viewer is less than the proper distance d, one of positions of the right eye RE (or the right pupil) and the left eye LE (or the left pupil) of the viewer may be set as a base position. Based on the base position, the viewed images R2 and L2 are divided into a plurality of viewpoint areas.

If the viewing distance of the viewer is m, if the proper distance is d, and if a distance between the two eyes (or the two pupils) of the viewer is E, the display apparatus may satisfy following Equations 31 to 32.

$$m: k = (d-m): \frac{E}{3} \quad \text{[Equation 31]}$$

$$k = \frac{mE}{3(d-m)} \quad \text{[Equation 32]}$$

When the base position is the position of the right eye RE, and when a specific area in the viewed image R2 is closer to a center of a first viewpoint area than a boundary between the first viewpoint area and a second viewpoint area, a subpixel corresponding to the first viewpoint area displays a right image component RI at the specific area in the viewed images R2 and L2. Subpixels corresponding to the second viewpoint area and the third viewpoint area display left image components LI at the specific area.

When the base position is the position of the right eye RE, and when a specific area in the viewed image R2 is closer to the boundary between the first viewpoint area and a second viewpoint area than the center of a first viewpoint area, subpixels corresponding to the first viewpoint area and the second viewpoint area display right image components RI at the specific area in the viewed images RI and LI. A subpixel corresponding to the third viewpoint area displays a left image component LI at the specific area.

According to one or more embodiments, when the viewer moves in forward and backward directions with respect to the display panel 10) (i.e., when the view moves toward the display panel 100 or moves away from the display panel 100), the display panel driver 300 may operate the proper subpixel rendering method so that the display panel 100 may display (or enable perception of) the 3D image.

Figure 18A:
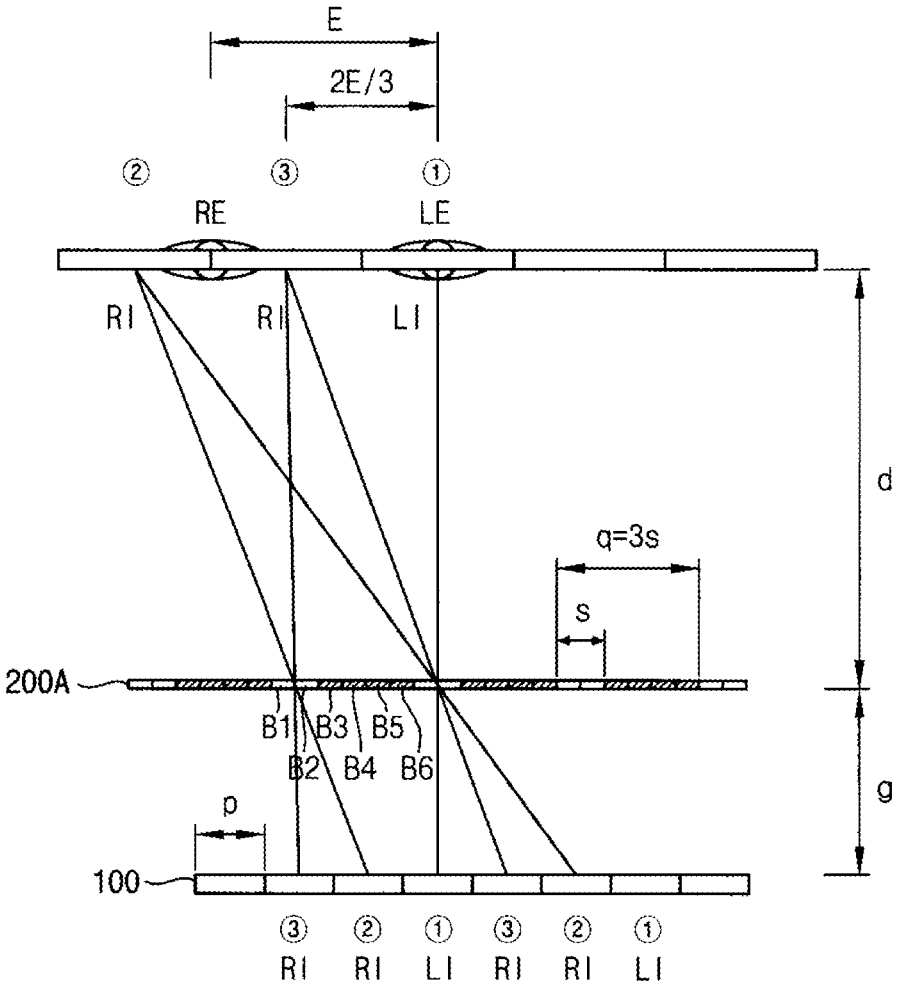
FIGS. 18A and 18B are diagrams illustrating a method of shifting a transmitting portion of the light controlling element illustrated in FIG. 13A for a new (or subsequent) frame and/or in each frame.
Figure 18B:
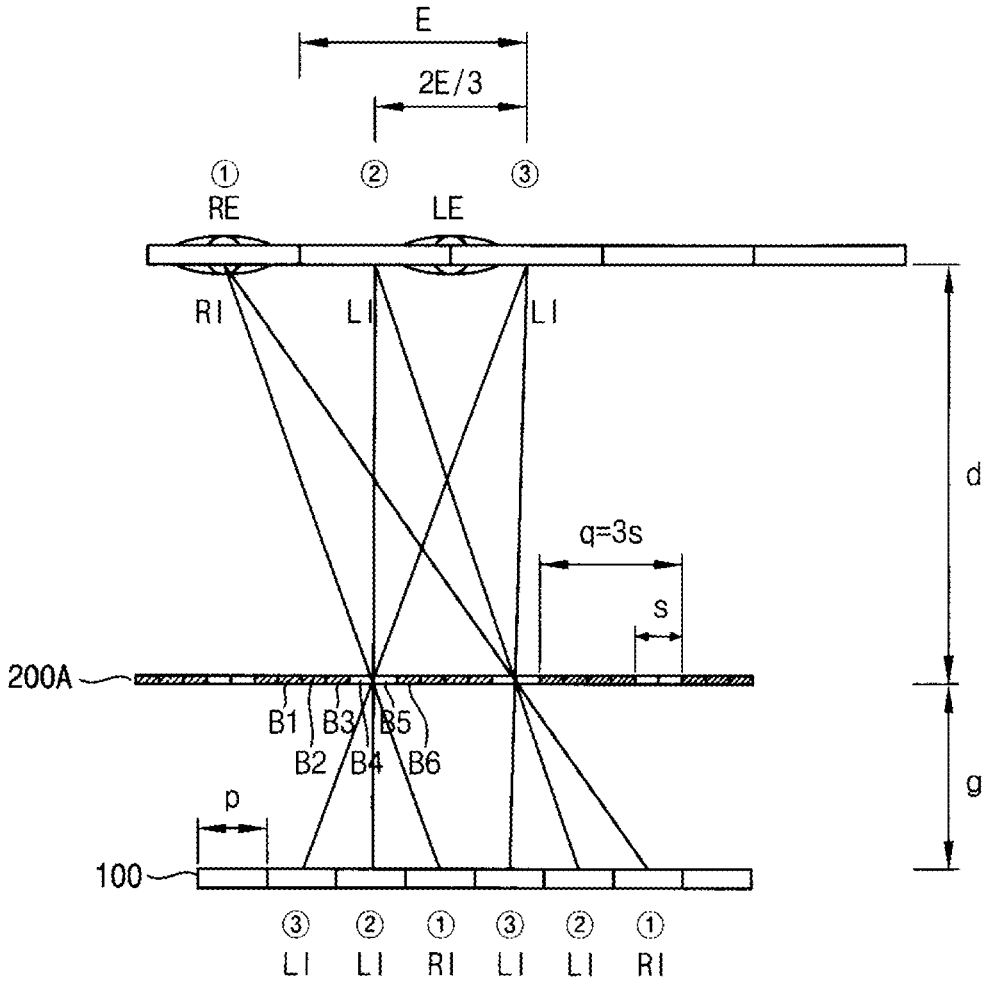

FIGS. 18A and 18B are diagrams illustrating a method of shifting a transmitting portion of the light controlling element 200A (also illustrated in FIG. 13A) for a new (or subsequent) frame and/or in each frame.

FIG. 18A illustrates the display apparatus in the first frame. FIG. 18B illustrates the display apparatus in the second frame.

In one or more embodiments, at least one transmitting portion (and/or each transmitting portion) of the light controlling element 200A is shifted for each new (or subsequent) frame and/or in each frame. The image components displayed on the subpixels of the display panel 100 may switch from right image component to left image component and may switch from left image components to right image components for each new (or subsequent) frame and/or in each frame.

Referring to FIG. 18A, the light controlling element 200A includes first to sixth portions B1 to B6 (in each six-portion set or each unit). In a first frame, a right image RI displayed on subpixels (e.g., the second subpixels and the third subpixels of three-subpixel sets) corresponding to the second and third viewpoints of a first three-viewpoint set is shown to a right eye RE of the viewer through the first and second portions B1 and B2. A left image LI displayed on subpixels (e.g., the first subpixels of three-subpixel sets) corresponding to the first viewpoint of a second three-viewpoint set immediately neighboring the first three-viewpoint set is shown to a left eye LE of the viewer through the first and second portions B1 and B2. In the first frame, transmitting portions of the light controlling element 200A may be at the portions B1 and B2 of the six-portion sets of the light controlling element 200A.

Referring to FIG. 18B, in a second frame, the right image RI displayed on subpixels (e.g., the first subpixels of three-subpixel sets) corresponding to the first viewpoint of the first three-viewpoint set is shown to the right eye RE of the viewer through the fourth and fifth portions B4 and B5. The left image LI displayed on subpixels (e.g., the second subpixels and the third subpixels of three-subpixel sets) corresponding to the second and third viewpoints of the first three-viewpoint set is shown to the left eye LE of the viewer through the fourth and fifth portions B4 and B5. In the first frame, transmitting portions of the light controlling element 200A may be at the portions B4 and B5 of the six-portion sets of the light controlling element 200A.

As can be appreciated from the discussion with reference to FIG. 18A and FIG. 18B, the transmitting portions of the light controlling element 200A may shift by a half of a pitch q of a unit of the light controlling element 200A, e.g., from first portions B1 and second portions B2 to fourth portions B4 and fifth portions B5, for each new (or subsequent) frame and/or in each frame. The pitch q is substantially equal to three times the width s of each portion and/or substantially equal to three times the width s of a transmitting portion.

According to one or more embodiments, the display panel driver 300 properly changes the image displayed by the display panel 100 according to the position of the viewer so that the 3D-image display apparatus may effectively display (or enable perception of) 3D images even if the viewer moves with respect to the display apparatus. The change of the displayed images for accommodating the viewer movement may not be substantially conspicuous to the viewer. Crosstalk also may be prevented so that a display quality of the 3D images may be satisfactory.

Figure 19:
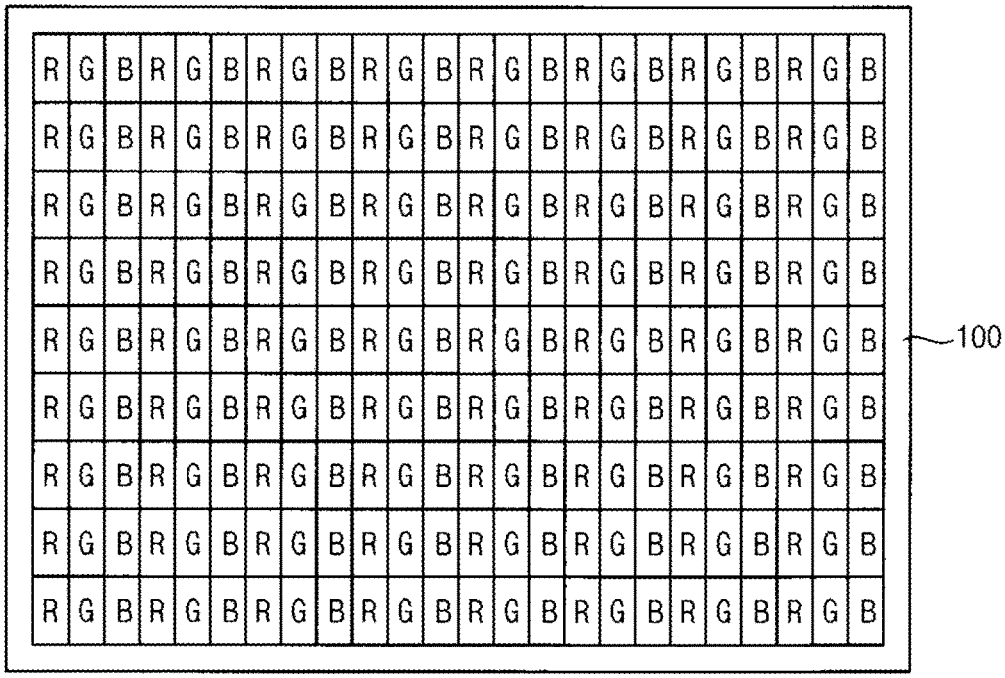
FIG. 19 is a plan view illustrating a pixel structure of a display panel according to one or more embodiments.
Figure 20:
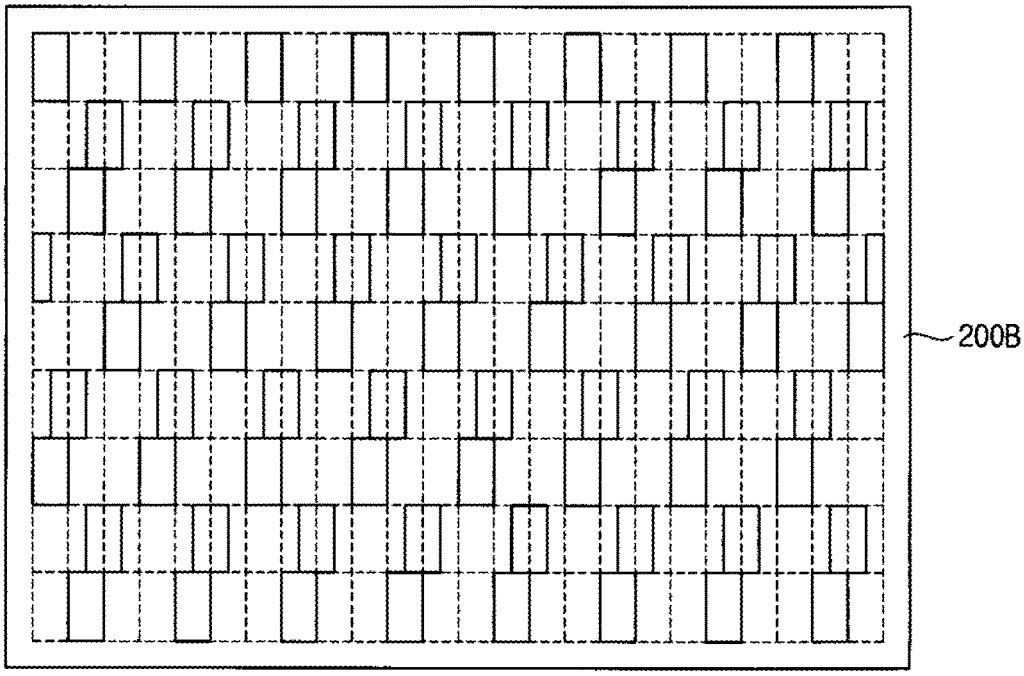
FIG. 20 is a plan view illustrating a configuration of the light controlling element illustrated in FIG. 19.
Figure 21:
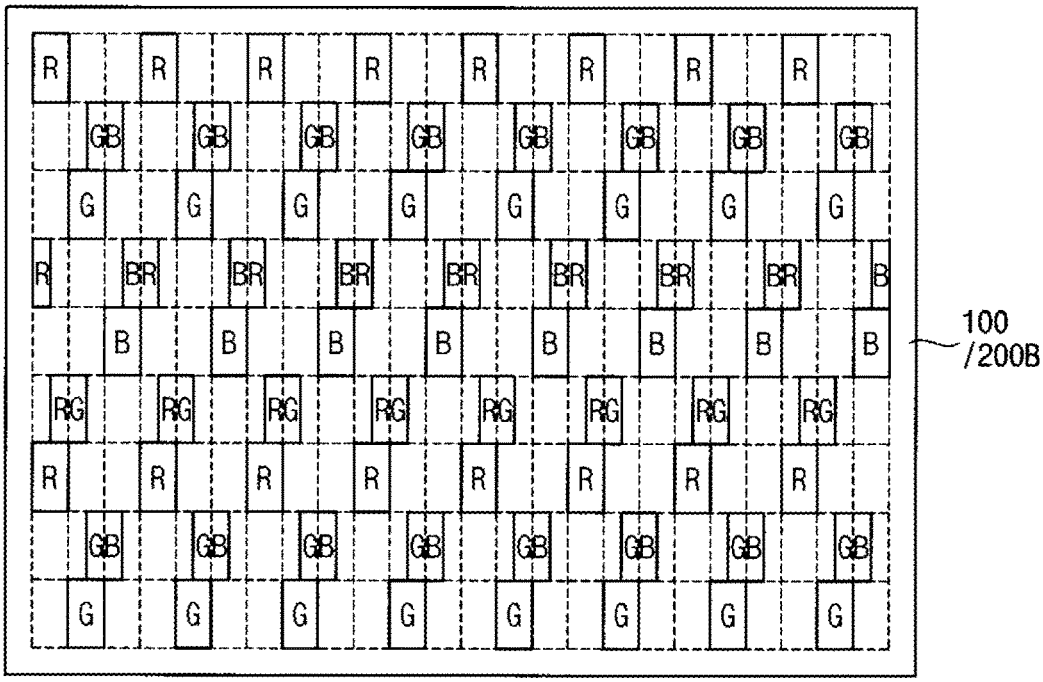
FIG. 21 is a plan view illustrating an image displayed by the display panel illustrated in FIG. 19 and shown to the viewer through the light controlling element illustrated in FIG. 20 at a viewpoint.

FIG. 19 is a plan view illustrating a pixel structure of the display panel 100 according to one or more embodiments. FIG. 20 is a plan view illustrating a configuration of a light controlling element 2008, which may be implemented in place of the light controlling element 200A. FIG. 21 is a plan view illustrating an image displayed by the display panel 100 illustrated in FIG. 19 and shown to the viewer through the light controlling element 200B illustrated in FIG. 20 at a viewpoint.

A display apparatus including elements illustrated in FIGS. 19 to 21 may be substantially as analogous to the display apparatus explained with reference to FIGS. 13A to 18B. Thus, same reference numerals may be used to refer to the same or like parts as those described with reference to FIGS. 13A to 18B, and repetitive explanation may be omitted.

Referring to FIGS. 1, 19 to 21, the display panel 100 includes a plurality of pixels. The pixels are disposed in a matrix form.

The pixels include a plurality of subpixels. Each subpixel may have a rectangular shape (or rectangular configuration). Each subpixel may have a shorter side in the first direction D1 and a longer side in the second direction D2.

The pixels (or a pixel) may include a red subpixel R, a green subpixel G and a blue subpixel B.

As illustrated in FIG. 19, the subpixels R, G, and B may be alternately (or sequentially and repeatedly) disposed along the first direction D1 (indicated in FIG. 1). The red subpixels R may be disposed in columns that extend in the second direction D2. The green subpixels G may be disposed in columns that extend in the second direction D2. The blue subpixels B may be disposed in columns that extend in the second direction D2.

The light controlling element 200B, as illustrated in FIG. 20, may be a barrier module having transmitting portions TA and blocking portions BA. The transmitting portions TA and the blocking portions BA may have matrix patterns. The barrier module includes a plurality of units. Each unit of the plurality of units may correspond to three subpixels and may include a transmitting portion TA and a blocking portions BA. In one or more embodiments, a ratio between a width of the transmitting portion TA in the first direction D1 and a width of the blocking portion BA in the first direction D1 in the unit barrier is about 1:2.

The transmitting portions TA corresponding to a third pixel row may be shifted by a width of a subpixel or by a width of a transmitting portion TA in the first direction D1 with respect to a position of the transmitting portions TA corresponding to a first pixel row. For example, a first transmitting portion TA corresponding to the first pixel row may be aligned in the second direction D2 (indicated in FIG. 1) with a first half of a first blocking portion BA corresponding to the third pixel row, wherein a first transmitting portion TA corresponding to the third pixel row may be disposed between the first half of the first blocking portion BA corresponding to the third pixel row and a second half of the first blocking portion BA corresponding to the third pixel row. The first transmitting portion TA corresponding to the third pixel row may be aligned in the second direction D2 with a first half of a first blocking portion BA corresponding to the first pixel row.

A second pixel row is disposed between the first pixel row and the third pixel row and immediately neighbors each of the first pixel row and the third pixel row. A transmitting portion TA corresponding to a second pixel row may be aligned in the second direction D2 (indicated in FIG. 1) with a midpoint between two immediately adjacent transmitting portions TA corresponding to the first pixel row. The transmitting portions TA corresponding to the second pixel row may be shifted by 1.5 times of a width of the subpixel or by 1.5 times of a width of a transmitting portion TA in the first direction D1 with respect to a position of the transmitting portions TA corresponding to the first pixel row. The transmitting portions TA corresponding to the second pixel row may be shifted by half a width of the subpixel or by half a width of a transmitting portion TA in the first direction D1 from with respect to a position of the transmitting portions TA corresponding to the third pixel row.

At a viewpoint, the subpixels R, G and B of the display panel 100 are shown to the viewer as illustrated in FIG. 21 through the transmitting portions TA of the light controlling element 200B. The subpixels shown to the viewer substantially evenly display the red color, the green color, and the blue color.

According to one or more embodiments, the display panel driver 300 properly changes the images displayed by the display panel 100 according to the position of the viewer so that the 3D-image display apparatus may effectively display (or enable perception of) 3D images even if the viewer moves with respect to the display apparatus. The change of the displayed images for accommodating the viewer movement may not be substantially conspicuous to the viewer. Crosstalk also may be minimized or prevented so that the display quality of the 3D images may be satisfactory.

According to one or more embodiments of the present invention, the 3D-image display apparatus may effectively display (or enable perception of) 3D images even if the viewer moves in a horizontal direction parallel to the display panel of the display apparatus or in a forward or backward direction perpendicular to the display panel of the display apparatus.

The foregoing is illustrative of the present invention and is not to be construed as limiting thereof. Although a few embodiments of the present invention have been described, those skilled in the an will readily appreciate that many modifications are possible in the embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Modifications to the disclosed embodiments, as well as other embodiments, are intended to be included within the scope of the appended claims.

What is claimed is:

1. A display apparatus for enabling perception of a three-dimensional ("3D") image comprising:

a display panel including a plurality of subpixels, among the subpixels, a first group of two subpixels displaying a right image for a right eye of a viewer and a second group of two subpixels adjacent to the first group in a first direction displaying a left image for a left eye of the viewer;

a light controlling element transmitting an image on one subpixel to one viewpoint in the first direction and having four viewpoints;

a position detecting part detecting a position of the viewer; and a display panel driver switching the right image and the left image according to the position of the viewer, wherein a proper distance from the light controlling element for the 3D image is defined as a distance at which a width of a viewpoint image concentrated at each viewpoint through the light controlling element is substantially equal to a half of a distance of the two eyes of the viewer, when a viewing distance of the viewer is greater than the proper distance, one of positions of the right eye and the left eye of the viewer is set as a base position, and a viewed image is divided into a plurality of viewpoint areas based on the base position, wherein a width of the viewpoint area k is $$k = \frac{hE}{2(h-d)}$$

when the viewing distance of the viewer is greater than the proper distance, and h is the viewing distance of the viewer, d is the proper distance and E is the distance of the two eyes of the viewer.

2. The display apparatus of claim 1, wherein, when the base position is the position of the right eye, a first area is defined as an area corresponding to the viewpoint area in a right viewed image, two subpixels corresponding to two viewpoints defining the closest viewpoint area boundary display right images in the first area, and two subpixels corresponding to two viewpoints not defining the closest viewpoint area boundary display left images in the first area.

3. The display apparatus of claim 1, wherein the light controlling element is a barrier module having a transmitting portion and a blocking portion, wherein the barrier module includes a plurality of unit barriers, and wherein the transmitting portion of the light controlling element is shifted by a half of a distance between the adjacent transmitting portions in the first direction in each frame.

4. The display apparatus of claim 1, wherein at the proper distance, the display panel driver replaces the right image displayed on the subpixel with the left image when the viewer moves by a half of the distance between the two eyes of the viewer.

5. The display apparatus of claim 4, wherein a first subpixel and a second subpixel adjacent to the first subpixel display the right image, a third subpixel adjacent to the second subpixel and a fourth subpixel adjacent to the third subpixel display the left image, and when a luminance of the image on the first subpixel of the display panel shown to the right eye of the viewer becomes less than a luminance of the image on the third subpixel as the viewer moves in the first direction, the first subpixel displays the left image and the third subpixel displays the right image.

6. The display apparatus of claim 3, wherein the unit barrier corresponds to four subpixels, and a ratio between a width of the transmitting portion in the first direction and a width of the blocking portion in the first direction in the unit barrier is about 1:3.

7. The display apparatus of claim 3, wherein the transmitting portion and the blocking portion of the light controlling element have stripe patterns.

8. A display apparatus for enabling perception of a three-dimensional ("3D") image comprising:

a display panel including a plurality of subpixels, among the subpixels, a first group of two subpixels displaying a right image for a right eye of a viewer and a second group of two subpixels adjacent to the first group in a first direction displaying a left image for a left eye of the viewer;

a light controlling element transmitting an image on one subpixel to one viewpoint in the first direction and having four viewpoints;

a position detecting part detecting a position of the viewer; and a display panel driver switching the right image and the left image according to the position of the viewer, wherein a proper distance from the light controlling element for the 3D image is defined as a distance at which a width of a viewpoint image concentrated at each viewpoint through the light controlling element is substantially equal to a half of a distance of the two eyes of the viewer, when a viewing distance of the viewer is less than the proper distance, one of positions of the right eye and the left eye of the viewer is set as a base position, and a viewed image is divided into a plurality of viewpoint areas based on the base position, wherein a width of the viewpoint area k is $$k = \frac{mE}{2(d-m)}$$

when the viewing distance of the viewer is less than the proper distance, and m is the viewing distance of the viewer, d is the proper distance and E is the distance of the two eyes of the viewer.

9. The display apparatus of claim 8, wherein, when the base position is the position of the right eye, a first area is defined as an area corresponding to the viewpoint area in a right viewed image, two subpixels corresponding to two viewpoints defining the closest viewpoint area boundary display right images in the first area, and two subpixels corresponding to two viewpoints not defining the closest viewpoint area boundary display left images in the first area.

* * * * *